US009751384B2

(12) United States Patent
Shimaguchi et al.

(10) Patent No.: US 9,751,384 B2
(45) Date of Patent: Sep. 5, 2017

(54) GAS COMPRESSOR WITH DISCHARGE SECTION AND SUB-DISCHARGE SECTION

(71) Applicant: CALSONIC KANSEI CORPORATION, Saitama (JP)

(72) Inventors: Hirotada Shimaguchi, Saitama (JP); Kouji Hirono, Saitama (JP); Masahiro Tsuda, Saitama (JP); Tatsuya Osaki, Saitama (JP); Shizuma Kaneko, Saitama (JP)

(73) Assignee: CALSONIC KANSEI CORPORATION, Saitama (JP)

( * ) Notice: Subject to any disclaimer, the term of this patent is extended or adjusted under 35 U.S.C. 154(b) by 563 days.

(21) Appl. No.: 14/358,507

(22) PCT Filed: Nov. 22, 2012

(86) PCT No.: PCT/JP2012/080260

§ 371 (c)(1),
(2) Date: May 15, 2014

(87) PCT Pub. No.: WO2013/077388

PCT Pub. Date: May 30, 2013

(65) Prior Publication Data

US 2014/0369878 A1 Dec. 18, 2014

(30) Foreign Application Priority Data

Nov. 24, 2011 (JP) ..... 2011-256005
Mar. 16, 2012 (JP) ..... 2012-060233
Jun. 18, 2012 (JP) ..... 2012-136863

(51) Int. Cl.
*F04C 18/344* (2006.01)
*F04C 29/12* (2006.01)
(Continued)

(52) U.S. Cl.
CPC ..... *B60H 1/3223* (2013.01); *F04C 18/3441* (2013.01); *F04C 18/3442* (2013.01);
(Continued)

(58) Field of Classification Search
CPC .. F04C 2250/30; F04C 29/126; F04C 29/128; F04C 15/06; F04C 15/064; F04C 19/12; F04C 29/124; F04C 2250/102
(Continued)

(56) References Cited

U.S. PATENT DOCUMENTS 2,129,960 A * 9/1938 Presby ..... F04C 29/126 418/15
3,301,474 A * 1/1967 Büchel ..... F04C 27/02 418/15
(Continued)

FOREIGN PATENT DOCUMENTS

GB 506684 6/1939
GB 2107789 A * 5/1983 ..... F04C 29/12
(Continued)

OTHER PUBLICATIONS

International Search Report issued Feb. 19, 2013 in International (PCT) Application No. PCT/JP2012/080260 with English Translation.

*Primary Examiner* — Mary A Davis
(74) *Attorney, Agent, or Firm* — Wenderoth, Lind & Ponack, L.L.P.

(57) ABSTRACT

A gas compressor includes a cylinder member, a rotor, and a plurality of vanes, wherein a proximal section is provided between the cylinder member and the rotor, so that a single cylinder room which performs a refrigerant gas compression cycle one-time per one rotation of the rotor is defined, and at least one sub-discharge section which maintains pressure of the refrigerant gas in a compression room in discharge
(Continued)

pressure by releasing pressure of the compression room when the pressure of the refrigerant gas in the compression room reaches the discharge pressure.

8 Claims, 11 Drawing Sheets

(51) Int. Cl.

| | |
|---|---|
| ***F04C 28/16*** | (2006.01) |
| ***F01C 21/08*** | (2006.01) |
| ***B60H 1/32*** | (2006.01) |
| ***F25B 1/00*** | (2006.01) |
| *F04C 28/28* | (2006.01) |

(52) U.S. Cl.
CPC ..... *F04C 28/16* (2013.01); *F04C 29/126* (2013.01); *F04C 29/128* (2013.01); *F25B 1/005* (2013.01); *F01C 21/0863* (2013.01); *F04C 28/28* (2013.01); *F04C 2250/30* (2013.01)

(58) Field of Classification Search
USPC ..... 418/15
See application file for complete search history.

(56) References Cited

U.S. PATENT DOCUMENTS

| | | | | |
|---|---|---|---|---|
| 3,385,513 | A * | 5/1968 | Kilgore | F04C 29/128 418/15 |
| 4,389,170 | A * | 6/1983 | Hayashi | F04C 18/3442 418/15 |
| 4,408,968 | A | 10/1983 | Inagaki et al. | |
| 7,347,675 | B2 * | 3/2008 | Hasegawa | F01C 1/3442 418/15 |
| 2006/0073033 | A1 | 4/2006 | Sundheim | |
| 2008/0304474 | A1 | 12/2008 | Lam | |

FOREIGN PATENT DOCUMENTS

| | | |
|---|---|---|
| JP | 51-2015 | 1/1976 |
| JP | 54-28008 | 3/1979 |
| JP | 56-054986 | 5/1981 |
| JP | 56-150886 | 11/1981 |
| JP | 59-041691 | 3/1984 |
| JP | 60-52394 | 4/1985 |
| JP | 2008-513676 | 5/2008 |

* cited by examiner

SECT. A-A

GAS COMPRESSOR WITH DISCHARGE SECTION AND SUB-DISCHARGE SECTION

CROSS-REFERENCE TO RELATED APPLICATIONS

This application is based upon and claims priority from Japanese Patent Application No. 2011-256005 filed on Nov. 24, 2011, Japanese Patent Application No. 2012-136863 filed on Jun. 18, 2012, and Japanese Patent Application No. 2012-060233 filed on Mar. 16, 2012, in the Japan Patent Office, the disclosures of which are incorporated herein by reference in their entirety.

BACKGROUND OF THE INVENTION

1. Field of the Invention

The present invention relates to a gas compressor.

2. Description of Related Art

A vehicle such as an automobile includes an air conditioner which adjusts the temperature in a vehicle interior.

Such an air conditioner includes a refrigerant cycle which circulates a refrigerant (cooling medium) in order of a gas compressor, condenser, expansion valve, and evaporator.

The gas compressor in the refrigerant cycle is configured to compress the refrigerant gas with the evaporator, and send the high-temperature and high-pressure refrigerant gas to the condenser.

Such a gas compressor includes a vane rotary compressor (refer to, for example, JP 554-28008A).

The vane rotary compressor includes a hollow cylinder member, a rotor rotatably disposed inside the cylinder member, and a plurality of vanes which is attached to the rotor in a projectable and houseable manner, the vanes having leading ends which have contact with an inner circumferential surface of the cylinder member, so as to form a plurality of compression rooms inside the cylinder member.

A cylinder room which performs a refrigerant gas compression cycle by changing the volume of a compression room is formed between the cylinder member and the rotor. A suction section capable of sucking the refrigerant gas is provided upstream of the cylinder room, and a discharge section capable of discharging the refrigerant gas is provided downstream of the cylinder room.

However, the gas compressor has the following problems.

That is, the efficiency (COP (Coefficient of Performance: Cooling Capacity/Power)) of the vane rotary compressor tends to decrease compared to a compressor of another type.

This is because of the following reasons.

Namely,

1. The vane rotary compressor rapidly compresses refrigerant gas. For this reason, the refrigerant gas is excessively compressed, so that the power loss is increased due to the excessive compression.

2. The vane rotary compressor rapidly compresses refrigerant gas. For this reason, a pressure difference between adjacent compression chambers is increased, so that the refrigerant gas easily leaks from the vane by the compression difference.

This is especially a problem during high-load driving. This problem occurs not only in a case when a target to be compressed by the above compressor is refrigerant gas but also in a case when a target to be compressed by the above compressor is general gas.

SUMMARY OF THE INVENTION

The present invention has been made in view of the above circumferences, and an object of the present invention is to provide a gas compressor which can appropriately prevent excessive compression in a compression room and leakage of refrigerant gas from a vane.

A gas compressor according to the present invention includes a hollow cylinder member; a rotor rotatably disposed inside the cylinder member; and a plurality of vanes attached to the rotor in a projectable and houseable manner, the plurality of vanes including leading ends which have contact with an inner circumferential surface of the cylinder member, so as to form a plurality of compression rooms inside the cylinder member, wherein a cylinder room which changes a volume of the compression room, and performs a gas compression cycle is formed between the cylinder member and the rotor, a suction section which sucks the gas is provided upstream of the cylinder room, a discharge section which discharges the gas is provided downstream of the cylinder room, a proximal section in which the cylinder member and the rotor come close to each other is provided in only one position between the cylinder member and the rotor, so that a single cylinder room which performs the gas compression cycle one-time per one cycle for each compression room is formed, and at least one sub-discharge section, which maintains discharge pressure by releasing pressure of the compression room when the pressure of the gas in the compression room reaches the discharge pressure, is provided upstream of the discharge section.

In the gas compressor according to the present invention, it is preferable that the sub-discharge section be disposed relative to the adjacent discharge section or the sub-discharge section, so as to have an interval which is the same as an interval between the leading ends of the adjacent vanes or an interval narrower than that.

In the gas compressor according to the present invention, it is preferable that the sub-discharge section be disposed such that an interval along the inner circumferential surface of the cylinder member between the closest end portions of the discharge section and the sub-discharge section provided back and forth along the rotation direction of the vane or an interval along the inner circumferential surface of the cylinder member between the closest end portions of the two sub-discharge sections provided back and forth along the rotation direction of the vane is shorter than an interval along the inner circumferential surface of the cylinder between contact points where the leading ends of the two vanes provided back and forth along the rotation direction have contact with the inner circumferential surface of the cylinder member.

In the gas compressor according to the present invention, it is preferable that the sub-discharge section and the discharge section adjacent to the sub-discharge section or another sub-discharge section be disposed to have an interval in which the gas from the compression room is continuously discharged.

In the gas compressor according to the present invention, it is preferable that the sub-discharge section be formed in a position such that the total of an opening area of a part of or the entire discharge section and an opening area of a part of or the entire sub-discharge section becomes an entire opening area of a smaller discharge section between the discharge section and the sub-discharge section within a range between a surface (back surface in the rotation direction) facing the compression room in the vane provided downstream (front in the rotation direction) of the rotation direction and a surface (front surface in the rotation direction) facing the compression room in the vane provided upstream (back in the rotation direction) of the rotation direction of the rotor during a period after an extended line of the surface facing the compression room in the vane provided downstream of the rotation direction of the rotor passes through the entire sub-discharge section until the extended line passes through the entire discharge section in each compression room.

In the gas compressor according to the present invention, it is preferable that the sub-discharge section be formed in a position where the entire sub-discharge section and the entire discharge section simultaneously open within the range between the surface facing the compression room in the vane provided downstream of the rotation direction and the surface facing the compression room in the vane provided upstream of the rotation direction in one compression room in a specific period of the period.

In the gas compressor according to the present invention, it is preferable that the sub-discharge section be formed in a position such that a center of an opening of the sub-discharge section is disposed downstream of an extended line of a surface facing the compression room in the vane provided upstream of the rotation direction of the rotor in the compression room when an extended line of a surface facing the compression room in the vane provided downstream of the rotation direction of the rotor in each compression room passes through a center of an opening of the discharge section.

In the gas compressor according to the present invention, it is preferable that a distant section having the maximum interval in a radial direction between the cylinder member and the rotor in the cylinder room be formed in a position in front of a position at 90 degrees located downstream of the proximal section in the rotation direction of the rotor.

According to the gas compressor of the present invention, the following effects can be obtained.

Namely, the cylinder room is singulated, and the gas compression cycle is performed one-time per one cycle for each compression room. With this configuration, the gas can be smoothly compressed. Excessive compression is therefore appropriately controlled, so that power can be decreased, the pressure difference can be reduced between adjacent compression rooms, and a decrease in the volume efficiency due to the leakage of the gas from a vane can be prevented.

DETAILED DESCRIPTION OF THE INVENTION

An embodiment of a gas compressor according to the present invention will be described in detail with reference to the drawings.

Embodiment 1

FIGS. 1-5B illustrate Embodiment 1 of a gas compressor of the present invention, and Modified Example thereof.

<Configuration>

Configurations will be hereinafter described.

A vehicle such as an automobile includes an air conditioner which adjusts the temperature in a vehicle interior.

Such an air conditioner includes an evaporator, gas compressor, condenser, and expansion valve. The air conditioner includes a loop refrigerant cycle which circulates refrigerant gas (hereinafter, referred to as refrigerant) in order of the evaporator, gas compressor, condenser, and expansion valve.

The gas compressor compresses refrigerant gas as one example of gas evaporated in the evaporator, and sends high-temperature and high-pressure refrigerant gas to the condenser.

There are various types of a gas compressor. A vane rotary compressor includes the following configurations. Hereinafter, an example of an electric vane rotary compressor will be described. However, the present invention is not limited to the electric type.

Figure 1:
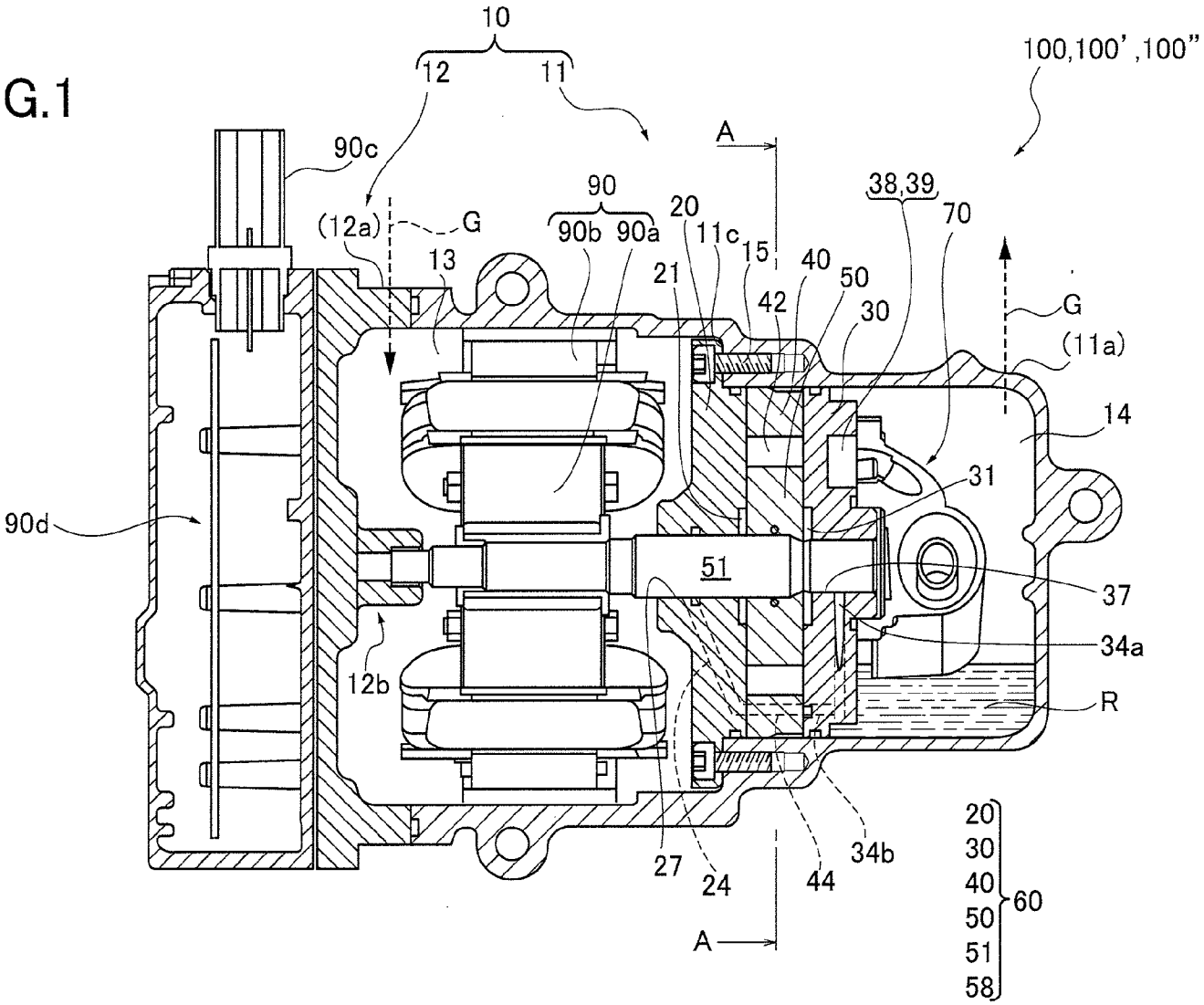
FIG. 1 is a sectional view of a gas compressor as seen from the side according to an embodiment of the present invention.

As illustrated in FIG. 1, a housing 10, which is the main body of the vane rotary compressor (hereinafter, referred to as a compressor 100), includes a front cover 12 and a main body case 11. The front cover 12 is a cover, and the main body case 11 is a container having at one end an opening. The opening is closed by the front cover 12.

The compressor 100 includes inside thereof a rotation shaft 51 in a shaft center position. The rotation shaft 51 is rotatably supported by bearings 12*b*, 27, 37 provided inside the housing 10 of the compressor 100. The bearing 12*b* which supports one end of the rotation shaft 51 is provided in the front cover 12. The bearings 27, 37 which support the other end of the rotation shaft 51 will be described below.

The compressor 100 includes inside thereof a motor unit 90, a compressor unit 60 which is a main body of the compressor, and a cyclone block 70 which is an oil separator. The rotation shaft 51 is shared by the motor unit 90 and the compressor unit 60.

The motor unit 90 includes a rotor 90*a* attached to the outer circumference of one end of the rotation shaft 51 and a stator 90*b* attached to the inside portion of one end of the front cover 12, so as to surround the rotor 90*a*. The rotor 90*a* is, for example, a permanent magnet and the stator 90*b* is, for example, an electric magnet. The rotor 90*a* and the stator 90*b* constitute a multiphase brushless direct-current motor.

However, the configuration of the rotor 90*a* and the stator 90*b* is not limited to the above. The motor unit 90 excites an electric magnet of the stator 90*b* by power supplied from the power source connector 90*c* attached to the front cover 12, and generates a rotation magnetic field between the rotor 90*a* and the stator 90*b*, so as to rotate the rotation shaft 51. An inverter circuit 90*d* is provided between the power source connector 90*c* and the stator 90*b* as appropriate.

In addition, in the case of a mechanical compressor 100, the rotation shaft 51 projects outside from the front cover 12, and a driving belt pulley which transmits power from an engine of a vehicle to the rotation shaft 51 through a driving power transmission mechanism is attached to the leading end portion of the projecting rotation shaft 51 instead of providing the motor unit 90.

On the other hand, the compressor 60 includes a hollow cylinder member (cylinder block) 40, a rotor 50 rotatably disposed inside the cylinder member 40, and a plurality of vanes 58 in which leading ends projectably and houseably attached to the rotor 50 have contact with the inner circumferential surface 41 of the cylinder member 40, so as to form a plurality of compression rooms 43 inside the cylinder member 40.

A cylinder room 42 in which a compression cycle (refrigerant cycle and refrigeration cycle) of refrigerant gas G is performed by changing the volume of the compression room 43 is formed in a space between the cylinder member 40 and the rotor 50.

A suction section 23 which can suck the refrigerant gas G is provided upstream of the cylinder room 42 in the rotation direction W of the rotor 50. A discharge section 45 (main discharge section) which can discharge the refrigerant gas G is provided downstream of the cylinder room 42.

The cyclone block 70 separates refrigeration oil R contained in the refrigerant gas G compressed by the compressor unit 60 with a centrifugal force. As illustrated in FIG. 1, the cyclone block 70 is attached to one surface side of an after-described rear side block 30, and is housed inside the main body case 11.

The heavy refrigeration oil R separated by the cyclone block 70 is accumulated in the bottom of the main body case 11. The light refrigerant gas G after the separation of the refrigeration oil R is discharged outside (condenser) through the top space in the main body case 11.

Next, the details of the compressor unit 60 will be described.

The cylinder member 40 is attached inside the other end of the main body case 11, as illustrated in FIG. 1. The cylinder member 40 is a circular plate member having a predetermined thickness and an outer diameter substantially equal to the inner diameter of the main body case 11.

A hollow portion which houses the rotor 50 is formed in the central portion of the cylinder member 40. One end and the other end of the cylinder member 40 are sandwiched by the front side block 20 and the rear side block 30 to be closed.

The front side block 20 and the rear side block 30 are a circular plate member having a predetermined thickness and an outer diameter substantially equal to the inner diameter of the main body case 11. The front side block 20 and rear side block 30 are fitted to the inner circumferential surface of the main body case 11 through a sealing member in an airtight condition. The front side block 20 is fastened to the main body case 11 with a fastener 15 such as a bolt.

A locking wall section 11*c* by which the front side block 20 can be positioned and locked with respect to the axis line direction of the rotation shaft 51 is provided inside the main body case 11.

Holes which are the bearings 27, 37 for supporting the rotation shaft 51 are formed in the front side block 20 and the rear side block 30, respectively.

Figure 2:
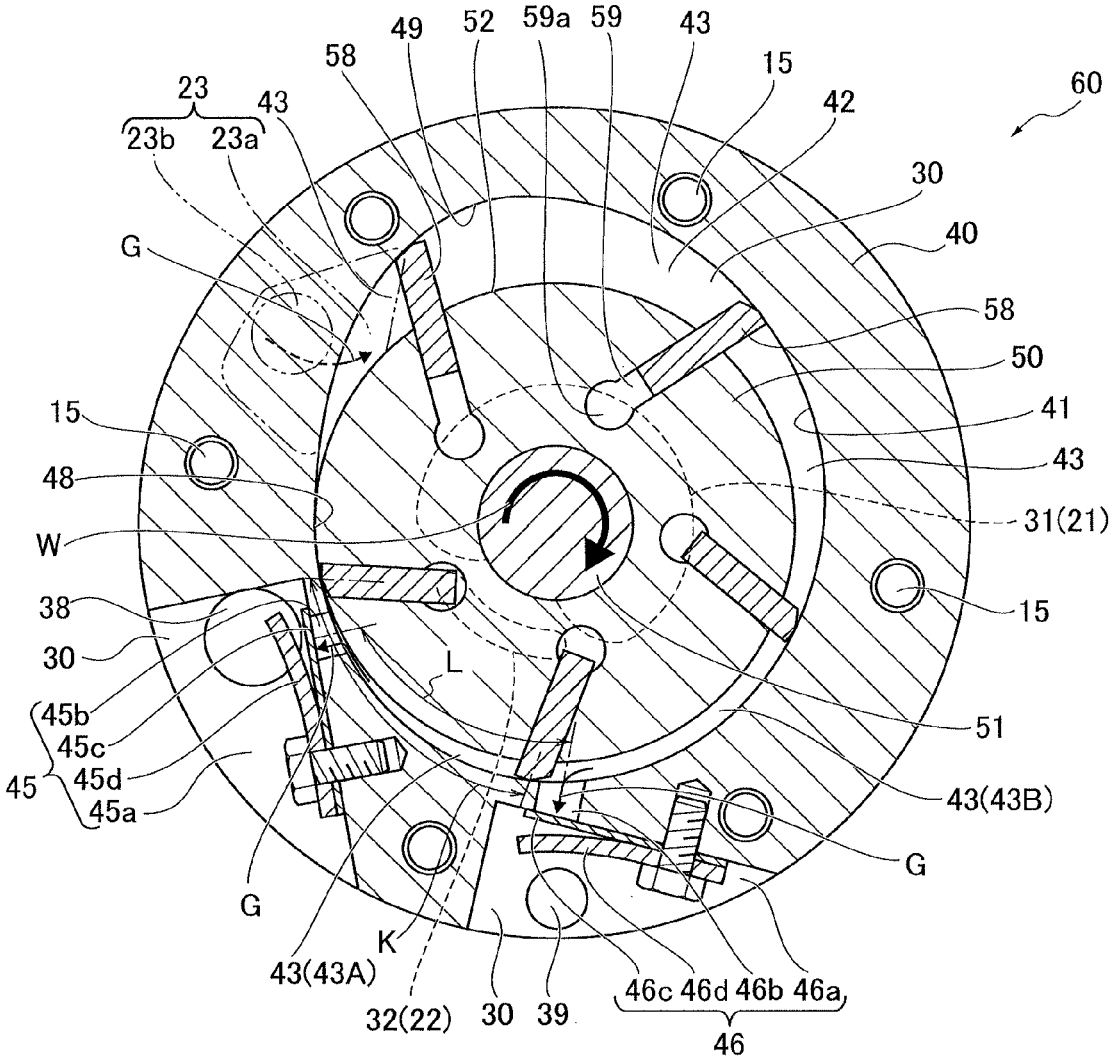
FIG. 2 is a sectional view of a compressor unit along A-A line in FIG. 1.

The suction section 23 is provided in the front side block 20, and the discharge section 45 is provided in the cylinder member 40 and the rear side block 30. As illustrated in FIG. 2, the suction section 23 includes a window-type inlet 23*a* which sucks the refrigerant gas G in the compression room 43, and a suction path 23*b* which guides the refrigerant gas G to the inlet 23*a*.

The discharge section 45 includes a discharge hole 45*b* which discharges the refrigerant gas G from the compression chamber 43, a discharge chamber 45*a* which houses the refrigerant gas G discharged from the discharge hole 45*b*, a discharge valve (check valve) 45*c* and a valve support 45*d* which switch the communication and the non-communication between the compression chamber 43 and the discharge chamber 45*a* by opening and closing the discharge hole 45*b*, and a discharge path 38 which is formed in the rear side block 30, so as to guide the refrigerant gas G of the discharge chamber 45*a* outside (cyclone block 70).

The rotor 50 is attached to the outer circumference of the rotation shaft 51. The rotor 50 is formed into a cylindrical shape, that sectioned contour of which is a true circle. The rotor 50 has a width which is the same as that of the cylinder member 40. The rotation shaft 51 is integrally attached to the center of the rotor 50, so that the rotor 50 rotates together with the rotation shaft 51. Both end surfaces of the rotor 50 have contact with the inside surfaces of the front side block 20 and the rear side block 30.

The vanes 58 are disposed to be projectable and houseable relative to a plurality of vane grooves 59 disposed in the rotor 50 at equal angle intervals along the circumferential direction to the rotor 50. For example, five vanes 58 are provided, and five vane grooves 59 are also provided in accordance with the number of vanes 58.

However, the number of vanes 58 and vane grooves 59 are not limited to this example. The leading end of the vane 58 is formed into a curved surface so as to smoothly follow the inner circumferential surface 41 of the cylinder member 40.

The vanes 58 and the vane grooves 59 may extend in the radial direction passing through the center of the rotor 50, or may extend in the direction having an inclination at a predetermined angle relative to the radial direction at a remote from the center of the rotor 50.

A back pressure room 59*a* which can apply back pressure for projecting the vane 58 is formed in the back portion of the vane groove 59. The leading end of the vane 58 projecting from the outer circumferential surface 52 of the rotor 50 is pressed to the inner circumferential surface 41 of the cylinder member 40 by the back pressure of the back pressure room 59*a*, so that the compression room 43 separated by the two vanes 58, 58 disposed back and forth along the rotation direction W is formed in the space (cylinder room 42) between the rotor 50 and the cylinder member 40.

Next, the path for the refrigerant gas G will be described.

As illustrated in FIG. 1, the compressor 100 includes a suction port 12*a* and a discharge port 11*a* for the refrigerant gas G. The suction port 12*a* is provided in the front cover 12, and the discharge port 11*a* is provided in the other end side of the main body case 11.

The refrigerant gas G from the evaporator is supplied to the suction port 12*a*, and the high-temperature and high-pressure refrigerant gas G is sent toward the condenser from the discharge port 11*a*. A suction room (or low-pressure room) 13 communicating with the suction port 12*a* is formed inside one end side of the main body case 11 provided with the motor unit 90. A discharge room (high-pressure room) 14 communicating with the discharge port 11*a* is formed inside the other end side of the main body case 11 provided with the cyclone block 70.

The suction room 13 and the suction section 23 of the compressor unit 60 are connected or communicate. The cyclone block 70 inside the discharge room 14 and the discharge section 45 of the compressor unit (compressor main body) 60 are directly or indirectly connected or communicate.

Next, the path for the refrigeration oil R in the compressor unit 60 will be described.

The rear side block 30 is provided with an oil duct 34*a* which sends the high-pressure refrigeration oil R accumulated in the bottom of the discharge room 14 to the bearing 37 (shaft hole). The oil duct 34*a* approximately extends in the up and down direction. A cleaning flute 31 (circumferential groove for supplying back pressure) capable of supplying the back pressure to each vane 58 is formed in the surface of the rear side block 30, which faces the rotor 50, by sending the refrigeration oil R passing through a narrow space between the bearing 37 and the rotation axis 51 to the back pressure room 59*a*.

An oil duct 44, which sends the refrigeration oil R passing through an oil duct 34*b* branched from the oil duct 34*a* of the rear side block 30, is provided in the lower portion of the cylinder member 40 along the rotation shaft 51 extending direction.

An oil duct 24, which sends the refrigeration oil R passing through the oil ducts 34*b*, 44 to the bearing 27 (shaft hole), is provided in the front side block 20 obliquely upward.

A cleaning flute 21 (circumferential groove for supplying back pressure) capable of supplying back pressure to each vane 58 by sending the refrigeration oil passing through a narrow space between the bearing 27 and the rotation shaft 51 to the back pressure room 59*a* is formed in the surface of the front side block 20 which faces the rotor 50.

Each of the cleaning flutes 31, 21 is formed to extend over an appropriate angle range along the circumferential direction, so as to communicate with the back pressure room 59*a* over an angle range which projects the vane 58, as illustrated in FIG. 2.

The present embodiment includes the following configurations with respect to the above-described basic configurations.

(Configuration 1)

As illustrated in FIG. 2, a proximal section 48 in which the cylinder member 40 and the rotor 50 come close to each other is formed in only one position within an angle range of one rotation of the rotor 50 between the cylinder member 40 and the rotor 50, so that a single cylinder room 42 which performs the compression cycle of the refrigerant gas G one-time per one cycle for each compression room 43 is formed.

One sub-discharge section 46, which maintains the pressure in the compression room 43 in the discharge pressure P by releasing the pressure in the compression room 43 when the pressure of the refrigerant gas G in the compression room 43 reaches the discharge pressure P (refer to FIG. 3), is provided upstream of the discharge section 45 (front side of the rotation direction).

In the proximal section 48, the cylinder member 40 and the rotor 50 are adjacent to each other to have a small clearance therebetween in a state close to a contact state.

The number of sub-discharge sections 46 is not limited to one in the present embodiment, and a plurality of sub-discharge sections 46 can be provided. The sub-discharge section 46 can be effectively used by disposing in a position D (refer to FIG. 3) where the pressure of the refrigerant gas G in the compression room 43 reaches the discharge pressure P without disposing in an arbitrary position. The sub-discharge section 46 in the present embodiment is disposed in such a position D.

The sub-discharge section 46 includes, similar to the (main) discharge section 45, a discharge hole 46*b* which discharges the refrigerant gas G having reached the discharge pressure P from the compression room 43, a discharge chamber 46*a* capable of housing the refrigerant gas G discharged from the discharge hole 46*b*, a discharge valve (check valve) 46*c* and a valve support 46*d* which switch the communication and the non-communication between the compression room 43 and the discharge chamber 46*a* by opening and closing the discharge hole 46*b*, and a discharge path 39 formed in the rear side block 30, which guides the refrigerant gas G of the discharge chamber 46*a* outside (cyclone block 70).

Hereinafter, the cylinder room 42 will be described.

Regarding the cylinder room 42, the shape of the inner circumferential surface 41 of the cylinder member 40 is set such that the volume basically increases (volume increase section) from the proximal section 48 or the suction section 23 toward a distant section 49 in which the distance between the inner circumferential surface 41 of the cylinder member 40 and the outer circumferential surface 52 of the rotor 50 is the maximum, or the volume basically decreases (volume decrease section) from the distant section 49 to the discharge section 45 or the proximal section 48.

In addition, the maximum volume of the compression room 43 is obtained at a specific one point where two vanes 58, 58 separating the compression room 43 sandwich the distant section 49. However, the position of this specific one point depends on the contour shape of the cylinder room 42, so that it differs according to the contour shape.

A suction stroke which sucks the refrigerant gas G, a compression stroke which compresses the refrigerant gas G, and a discharge stroke which discharges the refrigerant gas G are performed in this order in the compression cycle of the refrigerant gas G (one time repetition per one cycle for each compression room 43, for example, five-time repetition per one cycle for five compression rooms 43). Namely, the suction stroke is performed in the volume increase section, and the compression and discharge strokes are performed in the volume decrease section.

More specifically, the suction stroke is an interval when the front vane 58 of the compression room 43 in the rotation direction passes through the position on the upstream side of the suction port 23*a* until the back vane 58 of the compression room 43 passes through the position on the downstream side of the suction port 23*a*.

Moreover, the discharge stroke is an interval from the opening of the discharge valve 46*c* or the discharge valve 45*c* after the pressure of the refrigerant gas G in the compression room 43 has reached the discharge pressure P until the back vane 58 passes through the discharge hole 45*b*. The compression stroke is an interval between the suction stroke and the discharge stroke.

The suction port 23*a* is disposed in a position slightly shifted downstream of the proximal section 48, and the discharge hole 45*b* is provided in a position slightly shifted upstream of the proximal portion 48. The high-pressure discharge refrigerant gas G during discharging and the low-pressure refrigerant gas G during sucking are sealed between the discharge stroke and the suction stroke.

For this reason, the proximal section 48 can seal between the high-pressure refrigerant gas G and the low-pressure refrigerant gas G. The compression cycle in the single cylinder room 42 is performed within an angle range slightly smaller than 360 degrees.

The sub-discharge section 46 is set around the position D where the pressure of the refrigerant gas Gin the compression room 43 reaches the discharge pressure P in the latter part of the compression stroke. When the pressure of the refrigerant gas G reaches the discharge pressure P, the front vane 58 of the compression room 43 in the rotation direction passes through the sub-discharge section 46 or the (main) discharge section 45, so that the compression room 43 communicates with the sub-discharge section 46 or the (main) discharge section 45.

In this case, the position D where the pressure of the refrigerant gas G in the compression room 43 reaches the discharge pressure P is set in a position where the front vane 58 of the compression room 43 in the rotation direction locates at 270 degrees from the proximal section 48 in the rotation direction or a position located downstream of that position in the rotation direction. In this case, the set position depends on a driving condition, and this position changes upon a change in the driving condition. However, the position D where the pressure reaches the discharge pressure P is not limited to the above, and the position D differs according to the shape of the cylinder room 42.

The shape of the inner circumferential surface 41 of the cylinder member 40 is set such that the refrigerant gas G in the compression room 43 is smoothly compressed to be the discharge pressure P with low power until the position D where the pressure reaches the discharge pressure P. The inner circumferential surface 41 of the cylinder member 40 therefore becomes an asymmetric shape as illustrated. However, it is not necessary to excessively smooth the compression stroke.

(Configuration 2)

In the compressor 100 according to the above-described embodiment, the sub-discharge section 46 is disposed to have an interval L which is the same as the interval between the leading ends of the adjacent vanes 58, or an interval L slightly narrower than that, relative to the adjacent (main) discharge section 45 or another sub-discharge section (in this embodiment, there is no other sub-discharge section).

The compressor 100 of the present embodiment includes five vanes 58. With this configuration, the interval L between the sub-discharge section 46 and the (main) discharge section 45 adjacent to the sub-discharge section 46 or another sub-discharge section (in FIG. 2, the interval L is described as the interval based on an angle, but the interval can be an interval based on a length along the inner circumferential surface 41 of the cylinder member 40) is set to 72 degrees (72 degrees in which 360 degrees are divided by 5) which is the same as the interval K between the vanes 58, 58 or below.

If the compressor 100 includes four vanes 58, the interval L is set to 90 degrees in which 360 degrees for one cycle are divided by 4 or below. If more than five vanes 58 are provided, the interval L is similarly set by the above-described method according to the number of vanes 58.

The position of the sub-discharge section 46 and the position D where the pressure reaches the discharge pressure P are set to be a position of the integral multiple of the interval L from the discharge section 45 or a position slightly narrower than that. In addition, in the present invention, the integral multiple may include an error.

The interval L between the discharge section 45 and the sub-discharge section 46 in the configuration 2 is an interval based on a length along the inner circumferential surface 41 of the cylinder member 40 or an interval based on an angle about the rotation axis 51 between the position (illustrated by dashed line in FIG. 2) of the center of the discharge hole 45*b* of the discharge section 45 and the position (illustrated by dashed line in FIG. 2) of the center of the discharge hole 46*b* of the sub-discharge hole 46. On the other hand, the interval K between the leading ends of the adjacent vanes 58, 58 is an interval based on an angle about the rotation axis 51 or an interval based on a length along the inner circumferential surface 41 of the cylinder member 40 between the centers of the two vanes 58, 58 separating one compression room 43.

In the configuration 2, if there is another sub-discharge section, the interval L between the sub-discharge section 46 and another sub-discharge section is an interval based on a length along the inner circumferential surface 41 of the cylinder member 40 or an interval based on an angle about the rotation axis 51 between the position of the center of the discharge hole 46*b* of the sub-discharge section 46 and the position of the center of the discharge hole of another sub-discharge section.

(Configuration 3)

In the embodiment with the configuration 3, the sub-discharge section 46 is disposed relative to the adjacent discharge section 45 or another sub-discharge section so as to have the interval L which is the same as the interval K between the leading ends of the adjacent vanes 58, 58 or an interval slightly narrower than that. However, an interval based on an angle or a length between the inner edge portions of the discharge holes 46*b*, 45*b*, which is not based on the length or the angle between the centers of the discharge holes 46*b*, 45*b*, is adopted for the interval L between the sub-discharge section 46 and the discharge section 45 or the interval L between the sub-discharge section 46 and another sub-discharge section adjacent to the sub-discharge section 46.

Namely, in the embodiment with the configuration 1, the sub-discharge section 46 is disposed such that the interval L becomes shorter than the interval K (L<K), as illustrated in FIG. 4. The interval L is based on an angle about the center of the rotor 50 or based on a length along the inner circumferential surface 41 of the cylinder member 40 between the nearest edge sections 45*e*, 46*e* of the discharge hole 45*b* of the discharge section 45 and the discharge hole 46*b* of the sub-discharge section 46 provided back and forth along the rotation direction of the vane 58. The interval K is based on an angle about the center of the rotor 50 or based on a length along the inner circumferential surface 41 of the cylinder member 40 between contact points 58*a*, 58*a* where the leading ends of the two vanes 58, 58 provided back and forth along the rotation direction have contact with the inner circumferential surface 41 of the cylinder member 40.

Figure 4A:
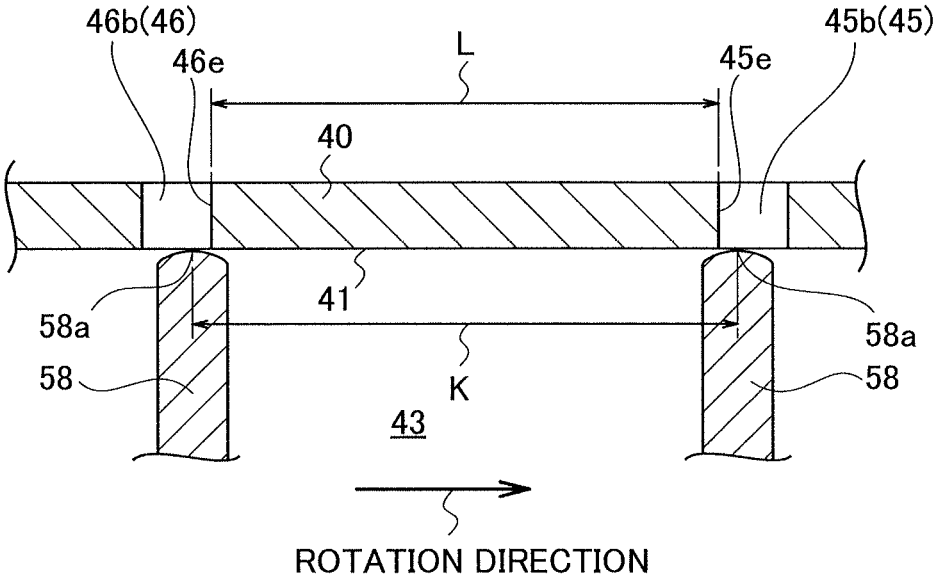
FIG. 4A is a schematic view illustrating a magnitude relationship of a length between vanes and a length between an end portion of a discharge section and an end portion of a sub-discharge section disposed upstream of the discharge section.

In addition, FIG. 4A illustrates the inner circumferential surface 41 of the cylinder member 40 in a planar manner, and illustrates an orientation and a positional relationship in which both of the vanes 58, 58 are orthogonal to the inner circumferential surface 41 and are parallel to each other. This is for schematically describing the configuration 3. The inner circumferential surface 41 of the cylinder member 40 is actually formed to have an oval contour shape which gradually reduces the volume of the compression room 43 along the rotation of the rotor 50, and the vanes 58, 58 actually have an orientation and a positional relationship having an inclination angle of 72 degrees, as illustrated in FIG. 2.

Figure 4B:
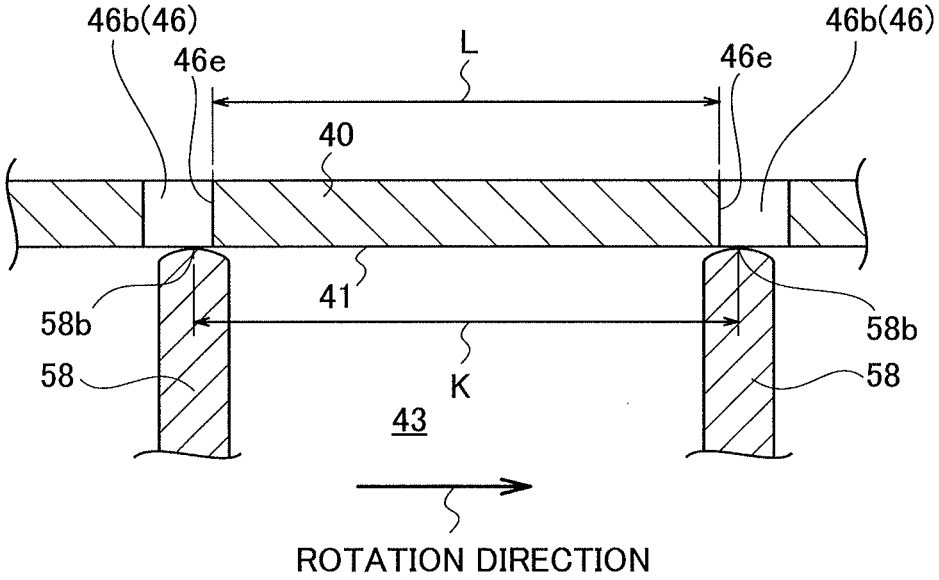
FIG. 4B is a schematic view illustrating a magnitude relationship of a length between vanes and a length between end portions of two sub-discharge sections disposed back and forth when two or more sub-discharge sections are provided upstream of the discharge section.

When one or more other sub-discharge sections (hereinafter, another sub-discharge section 46) are provided in addition to the sub-discharge section 46, as illustrated in FIG. 4B, an interval L based on an angle about the center of the rotor 50 or an interval L based on a length along the inner circumferential surface 41 of the cylinder member 40 between the nearest edge portions 46*e*, 46*e* of the discharge holes 46*b*, 46*b* of the two sub-discharge sections 46, 46 provided back and forth along the rotation direction of the vane 58 becomes shorter than an interval K based on an angle about the center of the rotor 50 or an interval K based on a length along the inner circumferential surface 41 of the cylinder member 40 between contact points 58*b*, 58*b* where the leading ends of the two vanes 58, 58 provided back and forth along the rotation direction have contact with the inner circumferential surface 41 of the cylinder member 41 (L<K).

(Configuration 4)

In the embodiment with the configurations 1-3, the sub-discharge section 46 and the adjacent discharge section 45 or the sub-discharge section 46 are set to have the interval L in which the refrigerant gas G is continuously discharged from the compression room 43. In addition, in the configuration 2, "slightly narrower" is for adjustment for obtaining the continuous discharge of the refrigerant gas G from the compression chamber 43.

In this case, the interval L is set to be narrower than the interval K between the leading ends of the adjacent vanes 58, 58 by approximately half of the thickness of the vane 58 or approximately the thickness of the vane 58, in order to prevent the interruption of the discharge due to the thickness of the vane 58. In addition, the effect cannot be obtained if the interval L is simply narrowed.

(Configuration 5)

In the embodiment with the configurations 1-4, the distant section 49 is provided in a position in front of the position at 90 degrees from the proximal section 48 in the rotation direction W (a position at 0 to 90 degrees from the proximal section 48 in the rotation direction W). The distant section 49 has the maximum interval along the radial direction passing through the center of the rotation between the outer circumferential surface 52 of the rotor 50 and the inner circumferential surface 41 of the cylinder member 40 in the cylinder room 42.

It is preferable for the distant section 49 to be set in a position close to the proximal section 48 as much as possible within a range which can ensure the suction amount of the refrigerant gas G required for the compression room 43 within the interval through which the vane 58 provided upstream of the rotation direction W passes in the suction stroke of the refrigerant gas G. The suction stroke is an interval from the start of the passage of the suction port 23*a* by the vane 58 provided downstream of the rotation direction W to the end of the passage of the suction port 23*a* by the vane 58 provided upstream of the rotation direction W.

<Function>

Hereinafter, the function of the above-described embodiment will be described.

At first, the compression of the refrigerant gas G will be described.

The refrigerant gas G supplied from the evaporator and introduced inside the compressor 100 from the suction port 12*a* is sent to a space (cylinder room 42) surrounded by the rotor 50 of the compressor unit 60, the cylinder member 40, and both side blocks 20, 30 from the suction section 23 provided in the front side block 20 through the suction room 13, and is sequentially supplied to each compression room 43 formed by the two vanes 58, 58 provided back and forth in the rotation direction inside the cylinder room 42.

The refrigerant gas G supplied to each compression room 43 is sent to the discharge section 45 provided in the rear side block 30 while being compressed by the rotation of the rotor 50, is discharged from the discharge section 45, is sent to the discharge room 14 through the cyclone block 70, is discharged outside through the discharge port 11*a* from the discharge room 14, and is sent to the downstream condenser.

The cylinder room 42 is separated into five compression rooms 43 by the vanes 58. One compression cycle including the suction stroke, compression stroke, and discharge stroke is performed in each compression room 43 during the rotation of the rotor 50 from the suction section 23 to the discharge section 45 in the rotation direction W. The refrigerant gas G compressed and discharged by this compression cycle becomes high-temperature and high-pressure refrigerant gas G.

Next, the flow of the refrigeration oil R in the compressor unit 60 will be described.

The high-pressure refrigeration oil R, which is separated from the refrigerant gas G in the cyclone block 70, and is accumulated in the bottom of the discharge room 14, is sent to the bearing 37 through the oil duct 34*a* provided in the rear side block 30 along the approximate up and down direction, and is sent to the groove 31 (circumferential groove for supplying back pressure) provided in the surface of the rear side block 30 facing the rotor 50 through a narrow space between the bearing 37 and the rotation shaft 51, and is supplied to the back pressure room 59*a* of the vane groove 59 from the groove 31, so that the back pressure is supplied to each vane 58.

The refrigeration oil R of the oil duct 34*a* of the rear side block 30 is sent to the bearing 27 of the front side block 20 through the oil duct 34*b* formed in the rear side block 30, the oil duct 44 provided in the cylinder member 40 in the lateral direction, and the oil duct 24 provided in the front side block 20 obliquely upward, is sent to the groove 21 (circumferential groove for supplying back pressure) provided in the surface of the front side block 20 facing the rotor 50 through the narrow space between the bearing 27 and the rotation shaft 51, and is supplied to the back pressure room 59*a* of the groove 59 from the groove 21, so that the back pressure is supplied to each vane 58.

The vane 58 projects from the outer circumferential surface 52 of the rotor 50 by the centrifugal force generated along the rotation of the rotor 50 and the high-pressure refrigeration oil R supplied to the back pressure room 59*a*, and is biased to have contact with the inner circumferential surface 41 of the cylinder member 40.

The refrigeration oil R supplied to the back pressure room 59*a* is introduced into each compression room 43 through a narrow space between the vane 58 and the vane groove 59, and is mixed with the refrigerant gas G in the compression room 43, is discharged from each compression room with the refrigerant gas G, is sent to the cyclone block 70, and is separated from the refrigerant gas G in the cyclone block 70. This function is repeated.

Next, the function of this embodiment will be described.

As Comparative Example 1, in the case of a normal vane rotary compressor, the proximal sections 48 of the cylinder member 40 and the rotor 50 are provided in two positions in the diametrical direction, and the cylinder rooms 42 are formed between both proximal sections 48, 48, so that two cylinder rooms 42 are formed.

The inner circumferential surface 41 of the cylinder 40 is formed into a symmetrical shape such as an oval shape having a minor axis in the position of the proximal section 48 and a major axis in the position at 90 degrees from the proximal section 48 in the rotation direction W. The compression cycle is performed two times per one rotation of the rotor 50 for each compression room 43. For example, ten compression cycles in total are repeated per one rotation of the rotor 50 if five compression rooms 43 are provided.

Figure 3:
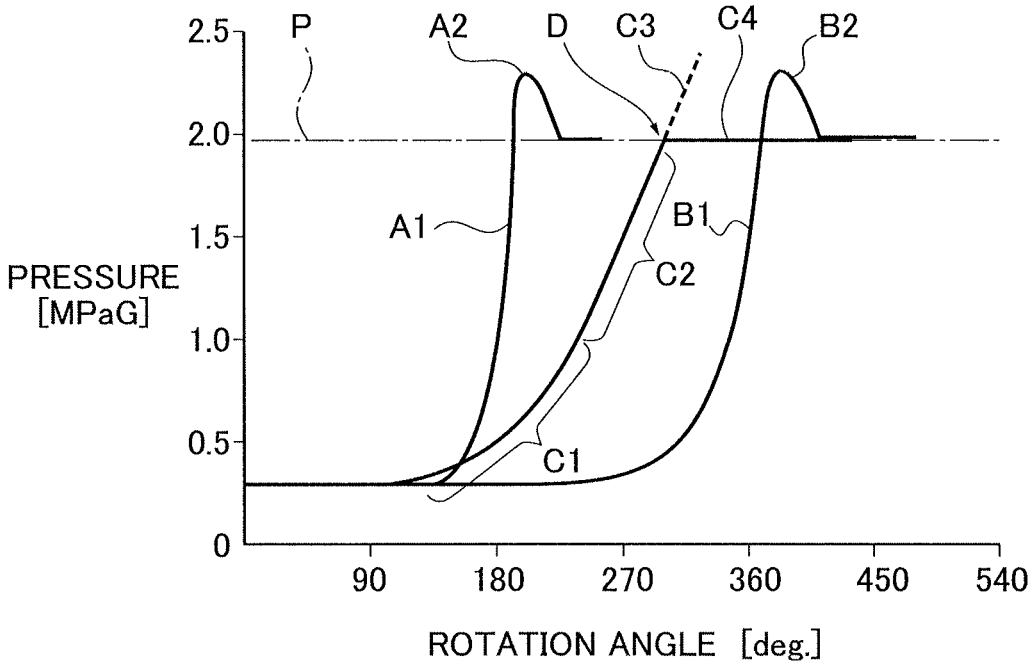
FIG. 3 is a graph illustrating a relationship between pressure and a rotation angle for describing the effects of the present embodiment.

With this configuration, in the compression cycle of one cylinder room 42, for example, the refrigerant gas G is rapidly compressed during the half rotation of the rotor 50 as illustrated by the line A1 in FIG. 3. Thus, high power is required. Moreover, the generation of excessive compression exceeding the discharge pressure as illustrated by the line A2 cannot be avoided until the start of the discharge of the refrigerant gas G.

As Comparative Example 2, if the vane rotary compressor is configured to have a single cylinder room 42, and perform the compression cycle one-time per one rotation of the rotor 50 for each compression room 43, as illustrated by the line B1 in FIG. 3, the compression timing of the refrigerant gas G delays by the half cycle compared with the line A1. High power is required because the refrigerant gas G is rapidly compressed similar to that in Comparative Example 1. The generation of excessive compression illustrated by the line B2 cannot be avoided until the start of the discharge of the refrigerant gas G.

On the other hand, the compressor 100 of the above-described embodiment is configured to singulate the cylinder room 42 by forming one proximal section 48, and the inner circumferential surface 41 of the cylinder member 40 is formed into a shape (asymmetric shape) which can smoothly compress the refrigerant gas G during approximately one cycle. The distant section 49 is provided in a position in front of a position at 90 degrees from the proximal section 48 in the rotation direction W. With this configuration, as illustrated by the line C1 in FIG. 3, the refrigerant gas G is sucked in the compression room 43 in an early stage, and is smoothly compressed inside the compression room 43 for a longer time, so that necessary power for compression is reduced.

As is known, the volume and the pressure of the gas have an inverse proportion relationship. Therefore, it is extremely difficult for the pressure to be compressed so as to proportionally increase over the entire area of the compression stroke.

In the first half of the compression stroke illustrated by the line C1 in FIG. 3, a change in the pressure is decreased even if the volume is largely decreased. For this reason, the compression is started at a timing faster than the line A1 or the line B1, and the refrigerant gas G is largely compressed to an extent which cannot be excessively smoothed although it is smoother than the lines A1, B1, so that both a reduction in power and effective compression can be obtained.

Moreover, in the second half of the compression stroke illustrated by the line C2 in FIG. 3, the pressure is largely changed by a small decrease in the volume. Therefore, the refrigerant gas G is compressed to be smoother than the lines A1, B1 and to obtain constant inclination as much as possible by adjusting the shape of the cylinder room 42, so that the volume is gradually decreased.

In this case, the shape of the cylinder room 42 is adjusted such that the connection line between the line C1 and the line C2 is smoothly changed, and the inclination of the line C2 is smoothly set. The excessive compression illustrated by the line C3 can be therefore reduced.

In the discharge stroke illustrated by the line C4 in FIG. 3, when the refrigerant gas G inside the compression room 43 reaches the discharge pressure P, the refrigerant gas G is discharged to the sub-discharge section 46 from the compression room 43. Therefore, the inside of the compression room 43 is maintained at the constant discharge pressure P.

The start timing of the discharge stroke can be thereby made faster, and the discharge stroke can be increased, so that the generation of excessive compression illustrated by the line C3 can be prevented.

The discharge from the discharge section 45 is performed following the discharge from the sub-discharge section 46.

In addition, FIG. 3 provides a graph illustrating the relationship between the pressure of the compression room 43 and the rotation angle (degree) of the rotor 50. In FIG. 3, the rotation angle of the rotor 50 uses the angle position of the front (downstream) vane 58 of the compression room 43 in the rotation direction W as a standard.

<Effect>

According to the compressor 100 of the embodiment as described above, the following effects can be obtained.

(Effect 1)

With the configuration which performs the compression cycle of the refrigerant gas G only one-time per one rotation of the rotor 50 for each compression room 43 by singulating the cylinder room 42, the refrigerant gas G can be smoothly compressed.

With this configuration, the excessive compression is appropriately controlled, the power is reduced, and the inside pressure difference between the adjacent compression rooms 43 is reduced. Thus, a decrease in the volume efficiency due to the leakage of the refrigerant gas G from the vane 58 can be prevented.

With the configuration which provides at least one or more sub-discharge section 46 upstream (optimum position) of the discharge section 45, the pressure of the compression room 43 can be maintained at the discharge pressure P by releasing the pressure of the compression room 43 from the sub-discharge section 46 when the pressure of the refrigerant gas G in the compression room 43 reaches the discharge pressure P. Therefore, the excessive compression in the compression room 43 can be reliably prevented.

The power waste due to the excessive compression can be therefore controlled, and thus, the effect can be improved. The discharge timing of the refrigerant gas G can be accelerated, and thus, the discharge effect can be improved.

The effect as the entire compressor 100 (COP (Coefficient Of Performance: Cooling Capacity/Power) can be improved.

(Effect 2)

By disposing the sub-discharge section 46 and the adjacent discharge section 45 or another sub-discharge section 46 at the interval L which is the same as the interval between the leading ends of the adjacent vanes 58, 58 or an interval slightly narrower than that, the sub-discharge section 46 can be effectively disposed in a position required for preventing the excessive compression.

(Effect 3)

In the present embodiment, the sub-discharge section 46 is disposed such that the interval L along the inner circumferential surface 41 of the cylinder member 40 between the end portions 45*e*, 46*e* of the discharge hole 45*b* of the discharge section 45 and the discharge hole 46*b* of the sub-discharge section 46 becomes shorter than the interval K along the inner circumferential surface 41 of the cylinder member 40 between the contact points 58*b*, 58*b* with the inner circumferential surface 41 of the cylinder member 40 of the two vanes 58, 58 (L<K). With this configuration 3, the compression room 43 separated by the two vanes 58, 58 provided back and forth along the rotation direction W communicates with the discharge hole 46*b* of the sub-discharge section 46 before the compression room 43 communicates with the discharge hole 45*b* of the discharge section 45, and the (front) vane 58 provided downstream of the rotation direction W of the compression room 43 faces the discharge hole 45*b* of the discharge section 45 before the (back) vane 58 provided upstream of the rotation direction W of the compression room 43 passes through the discharge hole 46*b* of the discharge section 46. Therefore, the sub-discharge section 46 can be effectively disposed in a position required for preventing the excessive compression.

In the present embodiment, two or more sub-discharge sections 46 are disposed, and the sub-discharge sections 46, 46 are disposed such that the interval L along the inner circumferential surface 41 of the cylinder member 40 between the end portions 46*e*, 46*e* of the discharge holes 46*b*, 46*b* of the two sub-discharge sections 46, 46 becomes shorter than the interval K along the inner circumferential surface 41 of the cylinder member 40 between the contact points 58*b*, 58*b* with the inner circumferential surface 41 of the cylinder member 40 of the two vanes 58, 58 (L<K). With this configuration 3, the compression room 43 separated by the two vanes 58, 58 provided back and forth along the rotation direction W communicates with the discharge hole 46*b* of the (back) sub-discharge section 46 provided upstream of the rotation direction W before the compression room 43 communicates with the discharge hole 46*b* of the (front) sub-discharge section 46 provided downstream of the rotation direction W, and the vane 58 provided downstream of the rotation direction W of the compression room 43 faces the discharge hole 46*b* of the downstream sub-discharge section 46 before the vane 58 provided upstream of the rotation direction W of the compression room 43 passes through the discharge hole 46*b* of the upstream sub-discharge section 46. Therefore, both of the sub-discharge sections 46, 46 are effectively disposed in positions required for preventing the excessive compression.

As illustrated in FIGS. 4A, 4B, the sub-discharge section 46 is disposed such that the interval L between the closest end portions 45*e*, 46*e* of the discharge holes 45*b*, 46*b* of the discharge hole 45 and the sub-discharge hole 46 becomes shorter than the interval K between the contact points 58*b*, 58*b* where the leading ends of the two vanes 58, 58 have contact with the inner circumferential surface 41 of the cylinder member 40 (L<K). However, as the embodiment of the gas compressor according to the present invention, the sub-discharge section 46 can be disposed such that an interval L' (>L) along the inner circumferential surface 41 of the cylinder member 40 between the farthest end portions 45*f*, 46*f* of the discharge hole 46*b* of the sub-discharge section 46 and the discharge hole 45*b* of the discharge section 45 provided back and forth along the rotation direction W of the vane 58 becomes shorter than the interval K along the inner circumferential surface 41 of the cylinder member 40 between the contact points 58*a*, 58*a* where the leading ends of the two vanes 58, 58 provided back and forth along the rotation direction W have contact with the inner circumferential surface 41 of the cylinder member 40 (L'<K).

With the configuration as described above, when the discharge hole which communicates with the compression room 43 is changed to the discharge hole 46*b* from the discharge hole 45*b*, namely, when the leading end of the vane 58 passes through the discharge holes 45*b*, 46*b*, the sectional area of the portion which becomes the discharge path is not decreased even if the leading end of the vane 58 is inclined. Thus, the discharge operation can be smoothly performed.

Figure 5A:
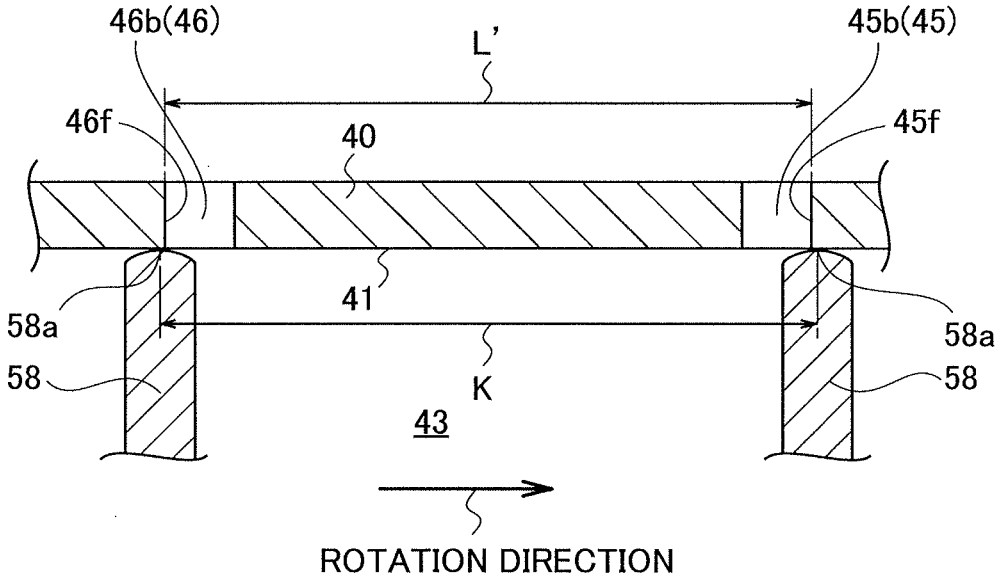
FIG. 5A is a schematic view corresponding to FIGS. 4A, 4B, and illustrating another embodiment and a magnitude relationship of a length between vanes and a length between an end portion of a discharge section and an end portion of a sub-discharge section disposed upstream of the discharge section.
Figure 5B:
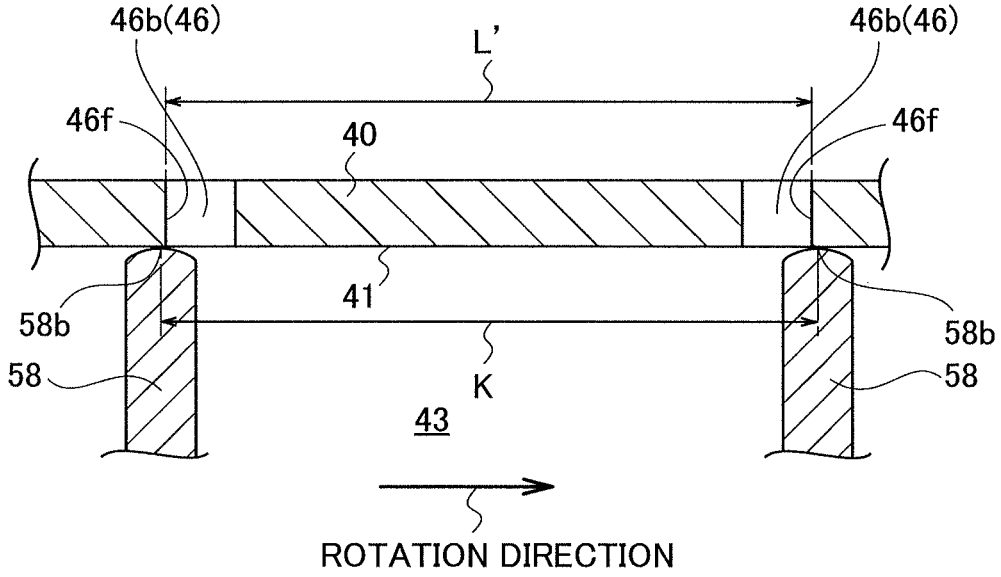
FIG. 5B is a schematic view corresponding to FIGS. 4A, 4B, and illustrating another embodiment and a magnitude relationship of a length between vanes and a length between end portions of two sub-discharge sections disposed back and forth when two or more sub-discharge sections are provided upstream of the discharge section.

Similarly, in addition to discharge section 45*b*'(45'), when two or more sub-discharge sections 46*b*'(46') are disposed, the sub-discharge sections 46*b*'(46') can be disposed such that the interval L' (>L) along the inner circumferential surface 41 of the cylinder member 40 between the farthest end portions 46*f*, 46*f* provided back and forth along the rotation direction W of the vane 58 becomes shorter than the interval K along the inner circumferential surface 41 of the cylinder member 40 between the contact points 58*b*, 58*b* where the leading ends of the two vanes 58, 58 provided back and forth along the rotation direction have contact with the inner circumferential surface 41 of the cylinder member 40 (L'<K), as illustrated in FIG. 5B.

(Effect 4)

By disposing the sub-discharge section 46 and the adjacent discharge section 45 or another sub-discharge section 46 at the interval L in which the refrigerant gas G from the compression room 43 is continuously discharged, the generation of excessive compression when the refrigerant gas G from the compression room 43 is not discharged can be prevented.

(Effect 5)

The distant section 49 in which the interval between the cylinder member 40 in the cylinder room 42 and the rotor 50 in the radial direction becomes the maximum is formed upstream of a position at 90 degrees located downstream of the proximal section 48 in the rotation direction W of the rotor 50, so that the suction stroke can be started with fast timing.

Therefore, the compression stroke and the discharge stroke are effectively performed, and the effect can be improved. For example, the compression stroke can be increased, the compression stroke can be smoothed, the start of the discharge stroke can be accelerated, and the discharge stroke can be increased.

Although the embodiment of the present invention has been described with reference to the drawings, the present invention is not limited thereto. It should be appreciated that variations may be made in the embodiment and the aspects without departing from the scope of the present invention.

When each embodiment includes a plurality of configurations, it is possible that each embodiment includes possible combinations of these configurations even if it is not specifically described.

When a plurality of embodiments and modified examples are described, it is possible that any configurations of the embodiments and the modified examples can be combined even if it is not specifically described.

The configurations illustrated in the drawings are included even if not specifically described.

Moreover, the term "such as" is used to include an equivalent. The terms "approximately", "about", or "substantially" are used to include an applicable range or accuracy.

Embodiment 2

FIGS. 6A to 10B illustrate Embodiment 2 of a gas compressor according to the present invention and Modified Example thereof.

The basic configuration of a compressor 100' of Embodiment 2 is the same as the configuration 1 of Embodiment 1 as illustrated in FIGS. 1, 2. It is the same as Embodiment 1 in that the sub-discharge section 46 is disposed to have the interval L narrower than the interval between the leading ends of the adjacent vanes 58 relative to the adjacent (main) discharge section 45 or another sub-discharge section. However the measurement of the narrow distance differs from that in Embodiment 1.

The description of the function and the effect based on the configurations in addition to the above-described difference will be omitted in order to avoid duplication with the description of the compressor 100 according to Embodiment 1, and the configuration regarding the difference and the function and effect based on the configuration regarding the difference will be only described.

Figure 6A:
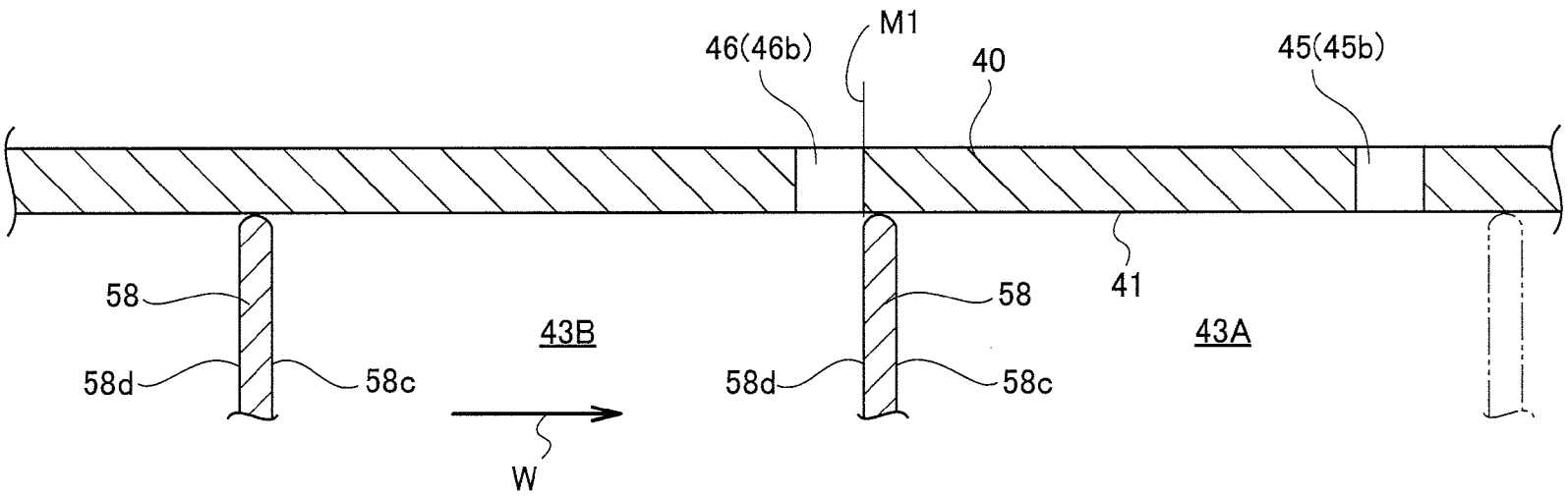
FIG. 6A is a schematic view illustrating a positional relationship of a main discharge section and a sub-discharge section in a compressor according to Embodiment 2, and illustrating a state in which an extended line of a back surface of a vane provided downstream of the rotation direction of the compression room passes through the entire discharge hole of the sub-discharge section.
Figure 6B:
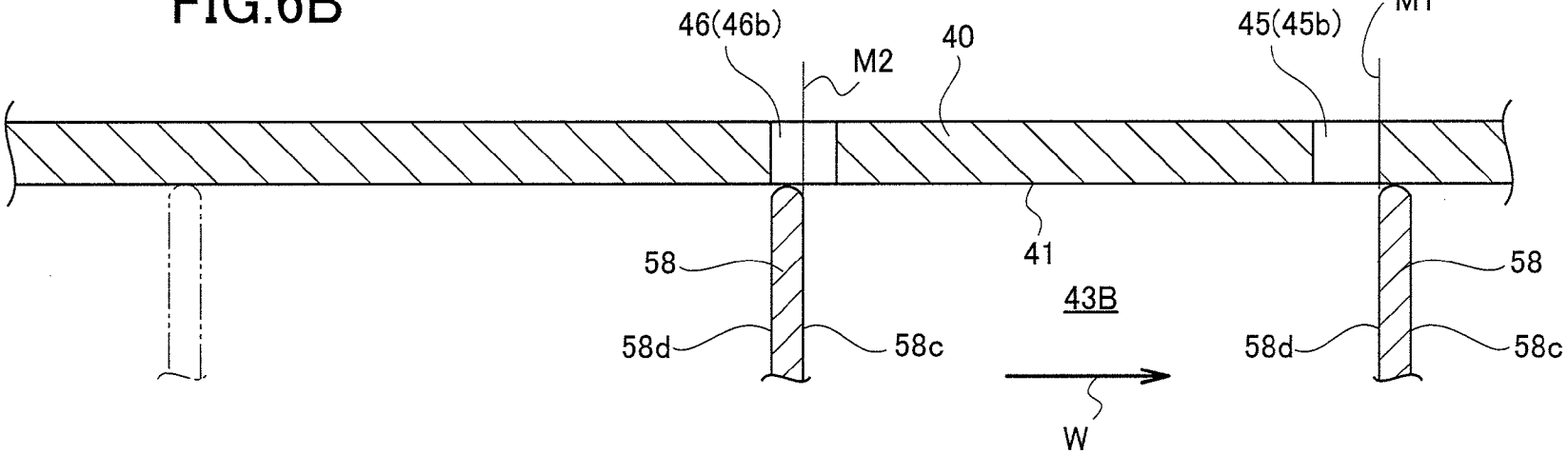
FIG. 6B is a schematic view illustrating a positional relationship of a main discharge section and a sub-discharge section in a compressor according to Embodiment 2, and illustrating a state in which an extended line of a back face of a vane provided downstream of the rotation direction of the compression room passes through the entire discharge hole of the main discharge section.
Figure 7A:
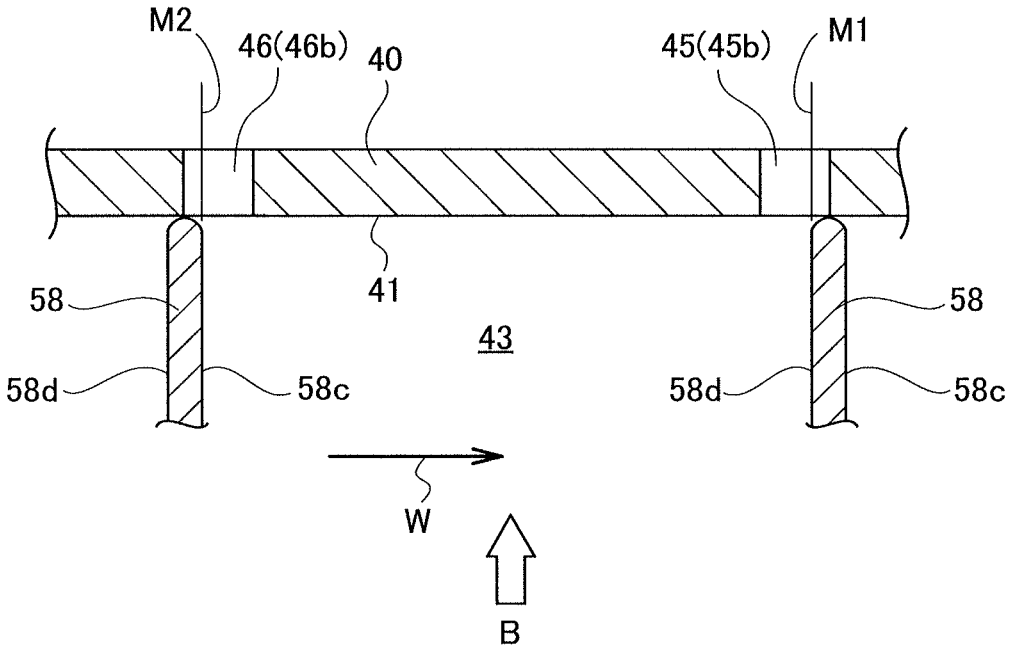
FIG. 7A is a schematic sectional view corresponding to FIGS. 6A, 6B, and illustrating a discharge hole of a sub-discharge section and a discharge hole of a main discharge section which open in one compression room during the period illustrated in FIGS. 6A, 6B.
Figure 7B:
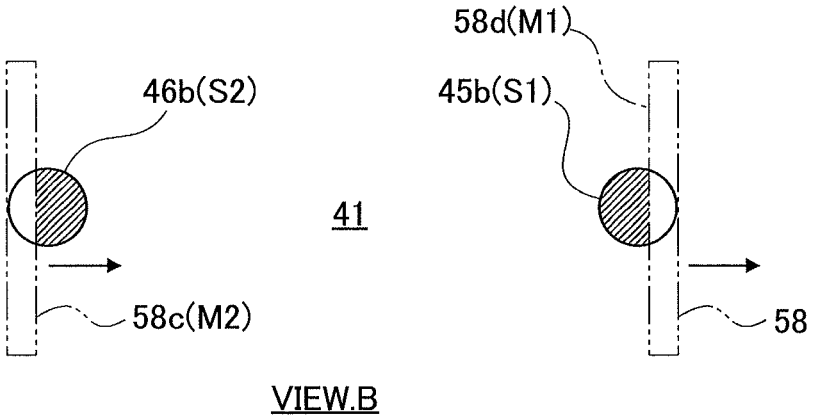
FIG. 7B is a schematic view illustrating the discharge hole of the sub-discharge section and the discharge hole of the main discharge section which open in one compression room during the period illustrated in FIGS. 6A, 6B, and illustrating an opening of each discharge hole according to the arrow B in FIG. 7A.

In the compressor 100' according to Embodiment 2, the discharge hole 46*b* of the sub-discharge section 46 is formed in a position such that the total S (=S1+S2) of an opening area S1 of a part of or the entire discharge hole 45*b* of the main discharge section 45 and an opening area S2 of a part of or the entire discharge hole 46*b* of the sub-discharge section 46, which open in the compression room 43B, becomes an area equal to or larger than the entire opening area of a smaller discharge hole between the discharge holes 45*b*, 46*b* of the discharge sections 45, 46 within the range between an extended line M1 and an extended line M2, as illustrated in FIGS. 7A, 7B, during the period after the extended line M1 passes through the entire discharge hole 46*b* of the sub-discharge section 46 (state illustrated in FIG. 6A) until the extended line M1 passes through the entire discharge hole 45*b* of the main discharge section 45 (state illustrated in FIG. 6B) as illustrated in FIGS. 6A, 6B, in accordance with the rotation of the rotor 50 in the rotation direction W. In this case, the extended line M1 is an extended line of a surface 58*d* (hereinafter referred to as a back surface 58*d*) facing the compression room 43B in the vane 58 (the right side vane 58 between the two vanes 58, 58 illustrated by the solid line in FIGS. 6A, 6B, 7A, 7B) provided downstream of the rotation direction W of the compression room 43 (for example, compression room 43B, and in addition, an adjacent compression room provided upstream of the compression room 43B is a compression room 43A), and the extended line M2 is an extended line of a surface 58*c* (hereinafter referred to as a front surface 58*c*) facing the compression room 43B in the vane 58 (the left side vane 58 between the two vanes 58, 58 illustrated by the solid line in FIGS. 6A, 6B, 7A, 7B) provided upstream of the rotation direction W.

In addition, FIGS. 6A, 6B, 7A, 7B illustrate the inner circumferential surface 41 of the cylinder member 40 in a planar manner, and an orientation and a positional relationship in which each vane 58 is orthogonal to the inner circumferential surface 41 and becomes parallel to each other. However, such schematic illustration is for simplifying the positional relationship between the compression room 43 and the discharge holes 45*b*, 46*b* of the discharge sections 45, 46. In Embodiment 2, the contour shape of the inner circumferential surface 41 of the cylinder member 40 is a curved line, and each vane 58 has contact with the inner circumferential surface 41 at an angle except 90 degrees. However, these are consistent with the configurations schematically illustrated in FIGS. 6A, 6B, 7A, 7B.

In this case, the opening areas of the discharge holes 45*b*, 46*b* can be an area on a surface along the inner circumferential surface 41 of the cylinder member 40 or a project area to a surface orthogonal to the extended line M1 of the back surface 58*d* of the vane 58 or the extended line M2 of the front surface 58*c* of the vane 58 when the vane 58 passes through the discharge holes 45*b*, 46*b*.

An entire opening area SA1 of the discharge hole 45*b* of the main discharge section 45 and an entire opening area SA2 of the discharge hole 46*b* of the sub-discharge section 46 are set to be equal to each other in the compressor 100' of the present embodiment. With this configuration, in the compressor 100' of the present embodiment, the discharge hole 46*b* of the sub-discharge section 46 is formed to be SA1≤S or SA2≤S.

In the compressor 100' of the present embodiment, as described above, the discharge hole 46*b* of the sub-discharge section 46 is formed in a position such that the total S (=S1+S2) of the opening area S1 of a part of or the entire discharge hole 45*b* of the main discharge section 45 and the opening area S2 of a part of or the entire discharge hole 46*b* of the sub-discharge section 46, which open in the compression room 43, becomes the entire opening area SA1 or more or the entire opening area SA2 or more of one of the discharge holes 45*b*, 46*b* of the discharge sections 45, 46 (SA1≤S or SA2≤S). Therefore, the refrigerant gas G can be smoothly and continuously discharged in the discharge chamber 45*a* of the main discharge section 45 or the discharge chamber 46*a* of the sub-discharge section 46 through an opening having a sufficient size S, namely, an opening (discharge holes 45*b*, 46*b*) having the opening area S of the entire opening area SA1 or more of the discharge hole 45*b* of the main discharge section 45 or the entire opening area SA2 or more of the discharge hole 46*b* of the sub-discharge section 46 even if the refrigerant gas G inside the compression room 43 is excessively compressed to exceed the discharge pressure P during the above described period (after the extended line M1 of the back surface 58*d* of the vane 58 provided downstream of the rotation direction W of the compression room 43 passes through the entire discharge hole 46*b* of the sub-discharge section 46 (state illustrated in FIG. 6A) until the extended line M1 passes through the entire discharge hole 45*b* of the main discharge section 45 (state illustrated in FIG. 6B)).

In the compressor 100' of Embodiment 2, during one rotation of the rotor 50, the suction, compression and discharge of the refrigerant gas G are performed only for one cycle. Thus, the refrigerant gas G can be smoothly compressed compared to a compressor which performs the suction, compression and discharge of the refrigerant gas G for two cycles during one rotation period of the rotor 50. The necessary power can be therefore reduced, and the pressure difference between the adjacent compression rooms 43, 43 provided back and forth along the rotation direction W can be reduced. A decrease in the effect due to the leakage of the refrigerant gas G from a tiny space between the vane 58 and the side blocks 20, 30 to the adjacent compression room 43 provided upstream of the rotation direction can be therefore controlled.

In the compressor 100' of Embodiment 2, similar to the configuration 5 of Embodiment 1, the distant section 49 of the inner circumferential surface 41 of the cylinder member 40 is formed in a position within 90 degrees located downstream of the proximal section 48 in the rotation direction W of the rotor 50. Therefore, the suction stroke can be started with faster timing.

The compression stroke and the discharge stroke are effectively performed, so that the effect can be improved. For example, the compression stroke can be increased, the compression stroke can be smoothed, the start of the discharge stroke can be accelerated, and the discharge stroke can be increased.

In the compressor 100' of the present embodiment, the entire opening area SA1 of the discharge hole 45*b* of the main discharge section 45 and the entire opening area SA2 of the discharge hole 46*b* of the sub-discharge section 46 are set to be equal to each other. However, the gas compressor according to the present invention is not limited to a compressor having the same opening area for two discharge sections (discharge hole), or can be a compressor in which one discharge section (discharge hole) has an opening area larger than that of the other discharge section (discharge hole). In this case, the second discharge section (sub-discharge section (discharge hole)) is provided in a position such that the total S of the opening areas of the discharge sections (discharge holes) which open in the compression room becomes larger than the opening area SA1 or SA2 of a discharge section (discharge hole) having a smaller opening area SA1 or SA2.

In addition, in terms of controlling the influence on the compression room provided upstream of the rotation direction W due to the refrigerant gas G accumulated in the dead volume of the sub-discharge section (discharge hole), it is preferable to set the opening area of the sub-discharge section (discharge hole) to be smaller than the opening area of the main discharge section (discharge hole).

Modified Example 1

In the compressor 100' of the present embodiment, only one sub-discharge section 46 is provided upstream of the rotation direction W of the rotor 50 relative to the main discharge section 45. However, the gas compressor according to the present invention is not limited thereto, and the configuration which provides another sub-discharge section upstream of the rotation direction W of the rotor 50 relative to the sub-discharge section 46 can be adopted.

Figure 8A:
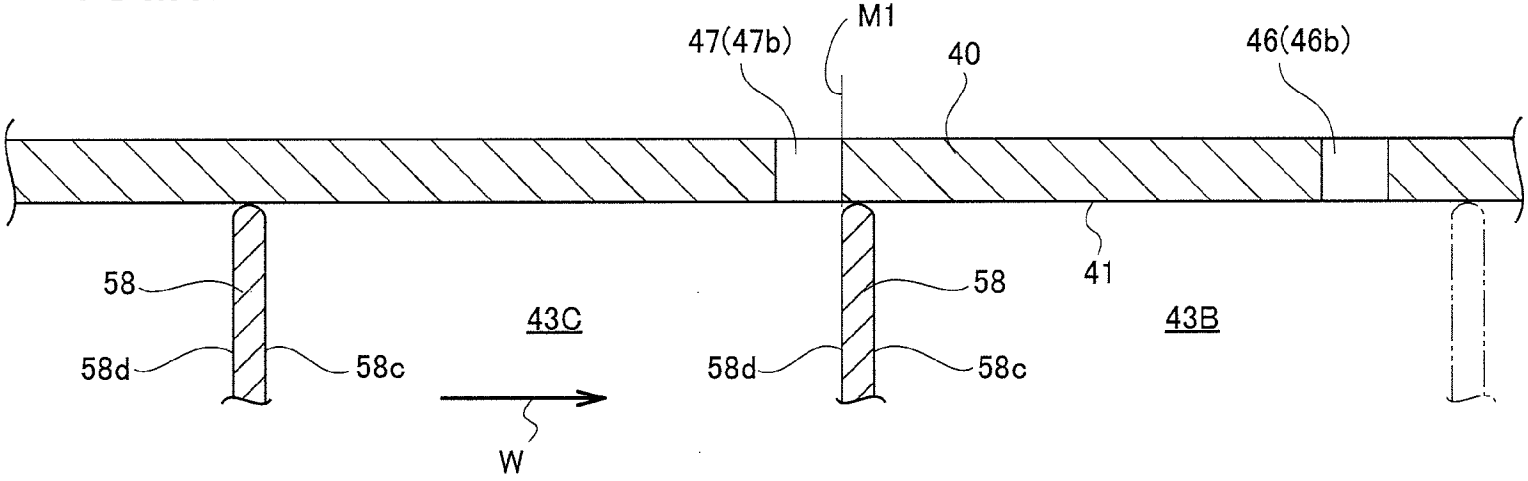
FIG. 8A is a schematic view illustrating a positional relationship between a first sub-discharge section and a second sub-discharge section in a compressor according to Modified Example 1, and illustrating a state in which an extended line of a back surface of a vane provided downstream of the rotation direction of the compression room passes through the entire discharge hole of the second sub-discharge section.
Figure 8B:
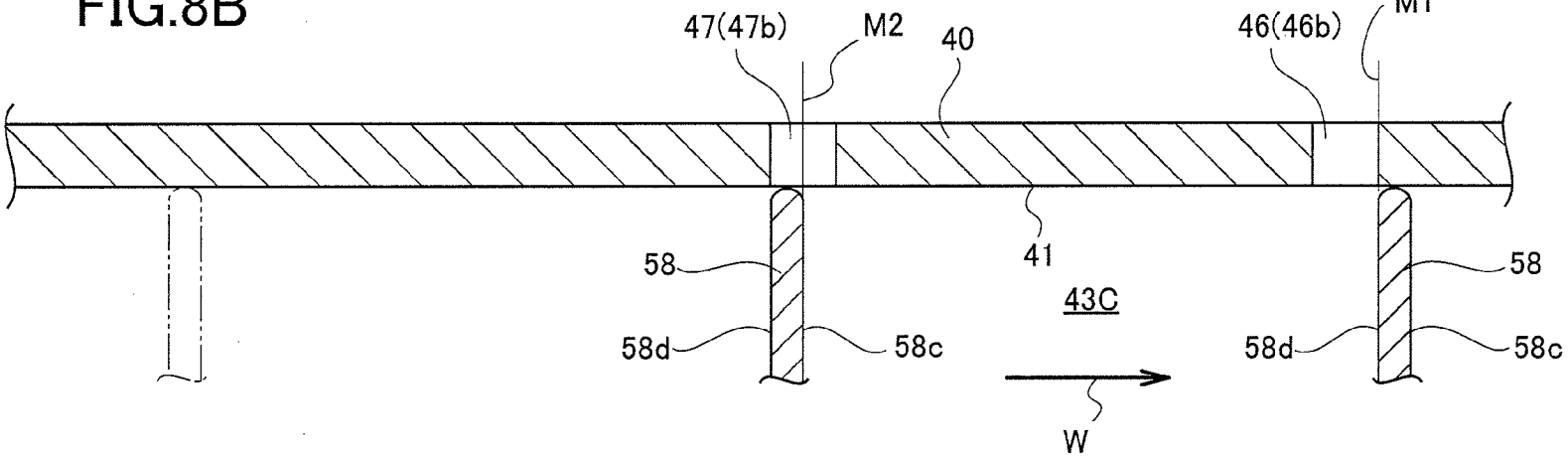
FIG. 8B is a schematic view illustrating a positional relationship between the first sub-discharge section and the second sub-discharge section in the compressor according to Modified Example 1, and illustrating a state in which the extended line of the back surface of the vane provided downstream of the rotation direction of the compression room passes through the entire discharge hole of the first sub-discharge section.
Figure 9A:
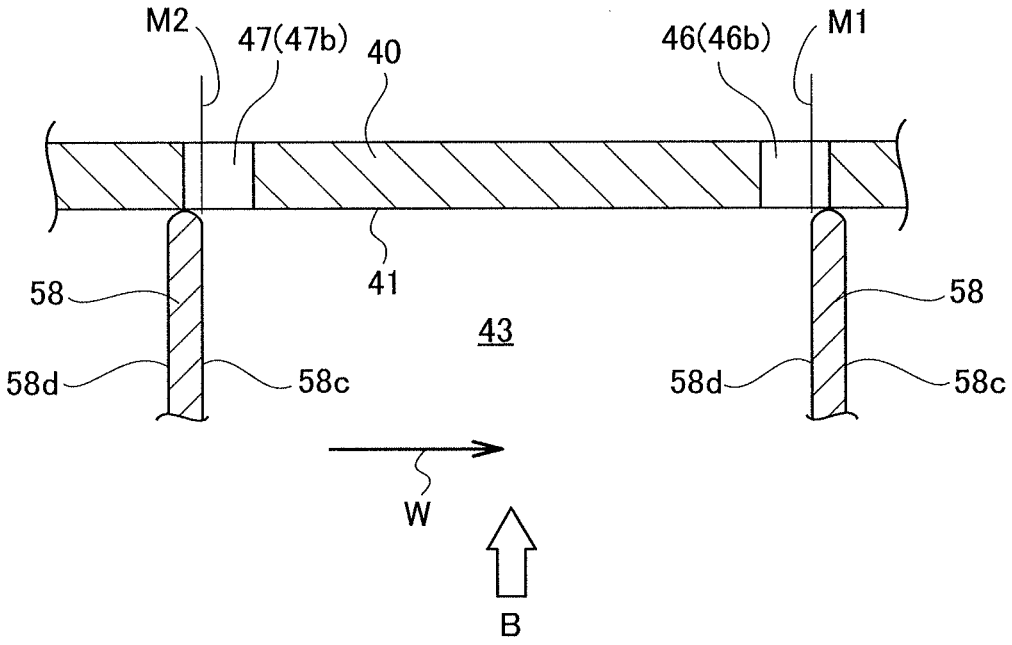
FIG. 9A is a schematic sectional view corresponding to FIGS. 8A, 8B, and illustrating a discharge hole of a sub-discharge section and a discharge hole of a main discharge section which open in one compression room during the period illustrated in FIG. 8A, 8B.
Figure 9B:
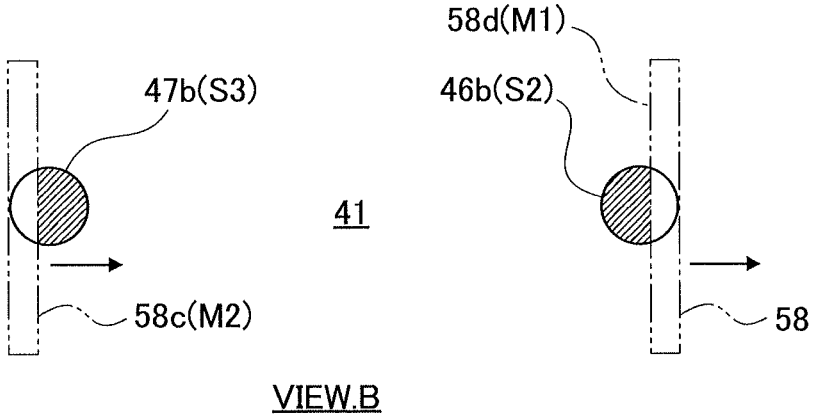
FIG. 9B is a schematic view illustrating the discharge hole of the sub-discharge section and the discharge hole of the main discharge section which open in one compression chamber during the period illustrated in FIG. 8A, 8B, and illustrating an opening of each discharge hole according to the arrow B in FIG. 9A.

In this case, as illustrated in FIGS. 8A, 8B, a discharge hole 47*b* of a further provided sub-discharge section 47 (hereinafter referred to as a second sub-discharge section 47) is formed in a position such that the total S' (=S2+S3) of an opening area S3 of a part of or the entire discharge hole 47*b* of the second sub-discharge section 47 which opens in the compression room 43C and an opening area S2 of a part of or the entire discharge hole 46*b* of the sub-discharge section 46 (hereinafter referred to as a first sub-discharge section 46) becomes the entire opening area (SA2 or SA3) or more of a smaller discharge hole between the discharge holes 46*b*, 47*b* of the sub-discharge sections 46, 47 within a range between an extended line M1 and an extended line M2, as illustrated in FIGS. 9A, 9B, during a period after the extended line M1 passes through the entire discharge hole 47*b* (entire opening area is SA3) of the second sub-discharge section 47 (state illustrated in FIG. 8A) until the extended line M1 passes through the entire discharge hole 46*b* of the first sub-discharge section 46 (state illustrated in FIG. 8B) by the rotation of the rotor 50 in the rotation direction W. In this case, the extended line M1 is an extended line of a surface 58*d* (hereinafter referred to as a back surface 58*d*) facing the compression room 43C in the vane 58 (the right vane 58 between the two vanes 58, 58 illustrated by the solid line in FIGS. 8A, 8B, 9A, 9B) provided downstream of the rotation direction W of the compression room 43 (for example, compression room 43C), and the extended line M2 is an extended line of a surface 58*c* (hereinafter referred to as a front surface 58*c*) facing the compression room 43C in the vane 58 (the left vane 58 between the two vanes 58, 58 illustrated by the solid line in FIGS. 8A, 8B, 9A, 9B) provided upstream of the rotation direction W.

According to the compressor 100' having the above configuration, the refrigerant gas G can be smoothly and continuously discharged in the discharge chamber 46*a* of the first sub-discharge section 46 or the discharge chamber 47*a* of the second sub-discharge section 47 from the compression room 43 through an opening having a sufficient area S', namely, an opening (discharge hole 46*b*, 47*b*) of an opening area S' which is the entire opening area SA2 or more of the discharge hole 46*b* of the first sub-discharge section 46 or the entire opening area SA3 or more of the discharge hole 47*b* of the second sub-discharge section 47 from at least one of the discharge hole 46*b* of the first sub-discharge section 46 and the discharge hole 47*b* of the second sub-discharge section 47 even if the refrigerant gas G inside the compression room 43 is excessively compressed to exceed the discharge pressure P during the period after the extended line M1 of the back surface 58*d* of the vane 58 provided downstream of the rotation direction W of the compression room 43 passes through the entire discharge hole 47*b* of the second sub-discharge section 47 (state illustrated in FIG. 8A) until the extended line M1 passes through the entire discharge hole 46*b* of the first sub-discharge section 46 (state illustrated in FIG. 8B).

Modified Example 2

Figure 10A:
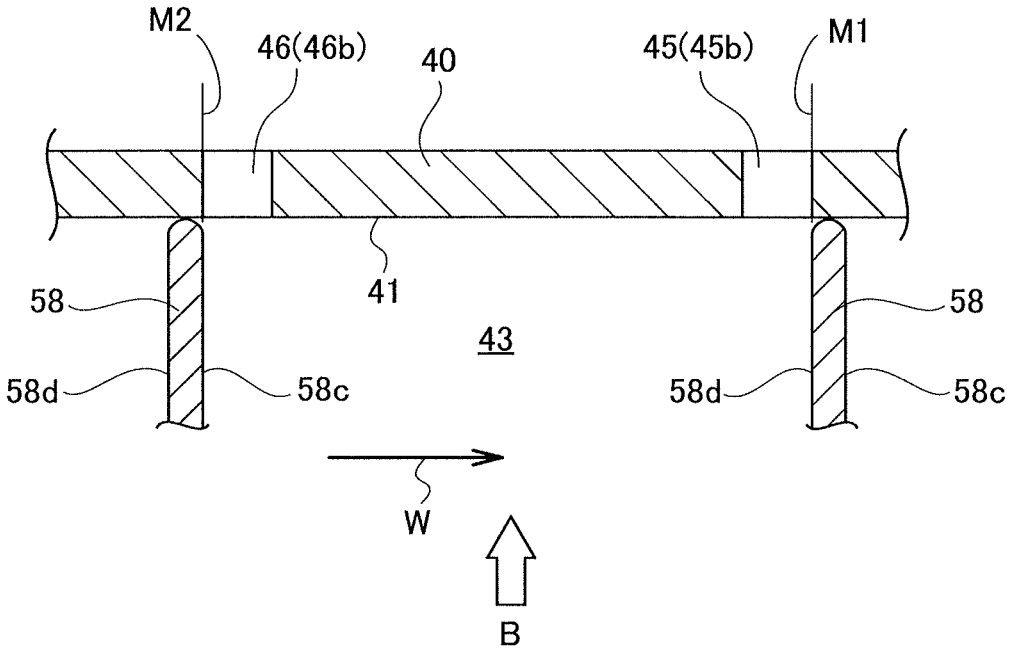
FIG. 10A is a sectional view corresponding to FIG. 9A, and illustrating Modified Example 2 of the compressor of Embodiment 2.
Figure 10B:
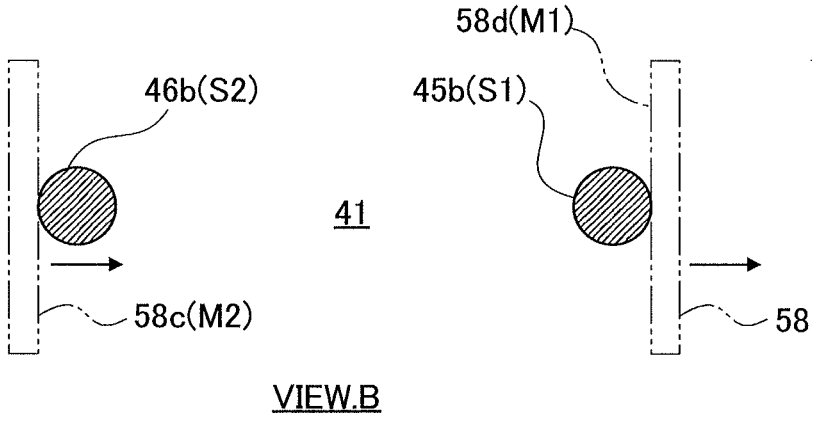
FIG. 10B is a view illustrating Modified Example 2 of the compressor of Embodiment 2, and illustrating an opening of each discharge hole based on the arrow B in FIG. 10A.

In the compressor 100' of the above-described embodiment, as illustrated in FIGS. 10A, 10B, the discharge hole 46*b* of the sub-discharge section 46 can be formed in a position such that the entire discharge hole 46*b* of the sub-discharge section 46 (opening area SA2) and the entire discharge hole 45*b* of the main discharge section 45 (opening area SA1) simultaneously open in one compression room 43 during a specific period in the above-described period (after the extended line M1 of the back surface 58*d* of the vane 58 provided downstream of the rotation direction W of the compression room 43 passes through the entire discharge hole 46*b* of the sub-discharge section 46 (the state illustrated in FIG. 6A) until the extended line M1 passes through the entire discharge hole 45*b* of the main discharge section 45 (the state illustrated in FIG. 6B)).

According to the compressor 100' in which the discharge hole 46*b* of the sub-discharge section 46 is formed in a position such that the entire discharge hole 46*b* of the sub-discharge section 46 and the entire discharge hole 45*b* of the discharge hole 45 simultaneously open in one compression room 43, the refrigerant gas G can be further smoothly discharged from the compression room 43 through the opening having a wider area S during the period in which the entire discharge hole 46*b* of the sub-discharge section 46 and the entire discharge hole 45*b* of the main discharge section 45 simultaneously open in the compression room 43.

Each of the discharge holes 45*b*, 46*b*, 47*b* of the sub-discharge sections 46, 47 in the compressor 100' according to the above-described Embodiment 2 and Modified Examples 1, 2 has a circular opening in the inner circumferential surface 41 of the cylinder member 40. However, the shape of the opening of each discharge section (discharge hole) according to the present invention is not limited thereto, and any shape such as a rectangular shape can be adopted. However, it is preferable for the discharge section (discharge hole) to have a circular shape in view of processability.

Embodiment 3

Figure 11A:
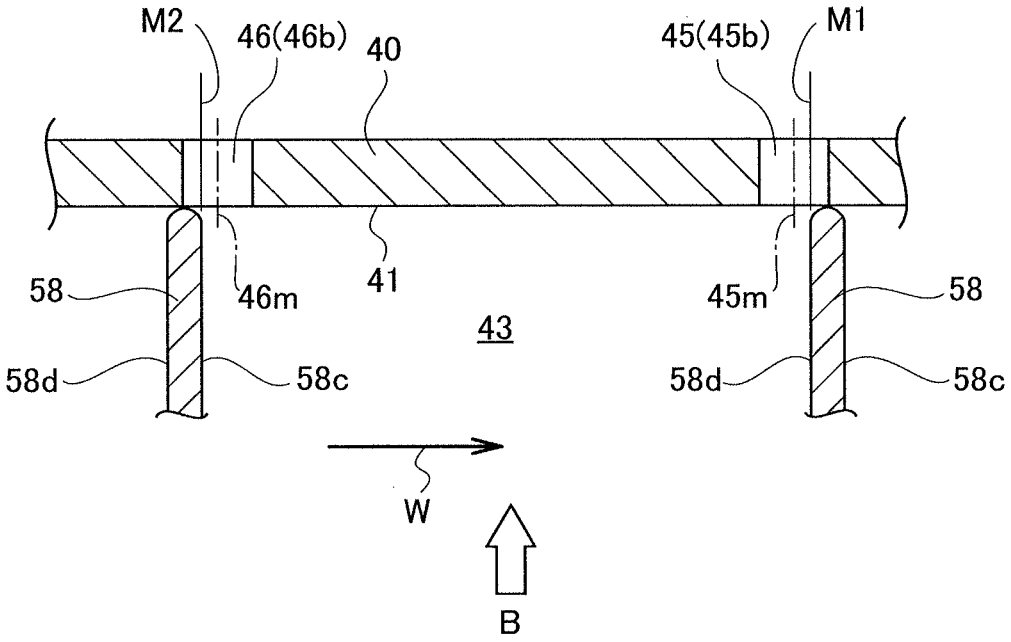
FIG. 11A is a sectional view corresponding to FIGS. 9A, 10A and illustrating a compressor according to Embodiment 3.
Figure 11B:
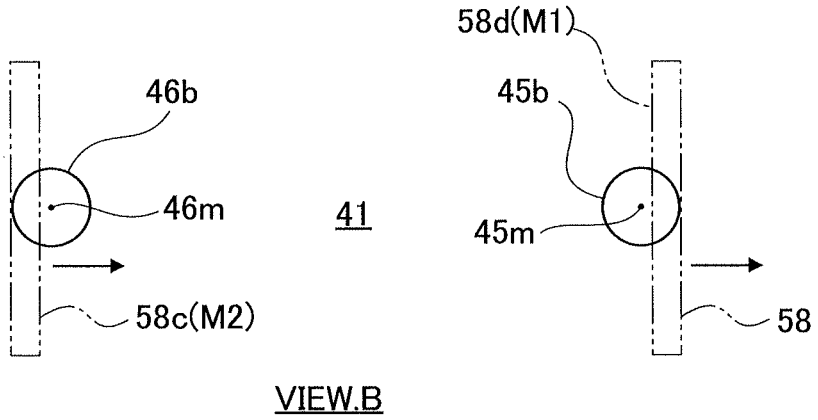
FIG. 11B is a view illustrating the compressor of Embodiment 3, and illustrating an opening of each discharge hole based on the arrow B in FIG. 11A.

FIGS. 11A, 11B illustrate Embodiment 3 of the gas compressor according to the present invention.

The basic configuration of the compressor 100" of the Embodiment 3 is the same as the configuration 1 of Embodiment 1 and Embodiment 2, and as illustrated in FIGS. 1, 2. It is the same as Embodiments 1, 2 in that the sub-discharge section 46 is disposed to have the interval L narrower than the interval between the leading ends of the adjacent vanes 58 relative to the adjacent (main) discharge section 45 or another discharge section. However, the measurement of the narrow interval differs from Embodiment 1.

Description regarding the configurations of the compressor 100" of Embodiment 3 except the configurations based on the difference with the compressors 100, 100', and the functions and effects based on the configurations will be omitted in order to avoid duplication with the description for each of the compressors 100, 100' of Embodiments 1, 2. The configurations based on the differences, and the functions and effects based on the configurations will be only described.

In the compressor 100" of Embodiment 3, as illustrated in FIGS. 11A, 11B, the discharge hole 46*b* of the sub-discharge section 46 is formed in a position such that a center 46*m* of the discharge hole 46*b* of the sub-discharge section 46 on the inner circumferential surface 41 is disposed downstream of the extended line M2 of the front surface 58*c* of the vane 58 provided upstream of the rotation direction W of the compression room 43 after the extended line M1 of the back surface 58*d* of the vane 58 provided downstream of the rotation direction W of the compression room 43 passes through a center 45*m* of the discharge hole 45*b* of the main discharge section 45 on the inner circumferential surface 41.

In addition, each discharge hole 45*b*, 46*b* of each discharge section 45, 46 on the inner circumferential surface 41 in the compressor 100" of Embodiment 3 has a circular shape. However, the shape of the opening of the discharge section (discharge hole) is not limited to the gas compressor according to the present invention. Any shape such as a rectangular shape or a triangular shape can be adopted.

In this case, the gravity center of the opening shape (various shapes such as rectangular shape or triangular shape) of the discharge section (discharge hole) on the inner circumferential surface of the cylinder is adopted as the center of the discharge section (discharge hole) which is the comparison target of the positional relationship with the extended lines of the front surface and the back surface of the vanes.

According to the compressor 100" of the above-described Embodiment 3, the discharge section 46*b* of the sub-discharge section 46 is provided in a positional relationship in which the center of the opening which is about ½ of the opening area of the discharge hole 46*b* of the sub-discharge section 46 and the center of the opening which is about ½ of the opening area of the discharge hole 45*b* of the main-discharge section 45 are provided in the range between the inner surfaces of the two vanes 58, 58 separating one compression room 43 (between the front surface 58*c* of the upstream vane 58 and the back surface 58*d* of the downstream vane 58). With this configuration, the refrigerant gas G can be smoothly and continuously discharged in the discharge chamber 45*a* of the main discharge section 45 or the discharge chamber 46*a* of the sub-discharge section 46 from the compression room 43 through an opening having a sufficient area from at least one of the discharge hole 46*b* of the sub-discharge section 46 and the discharge hole 45*b* of the main discharge section 45 even if the refrigerant gas G inside the compression room 43 is excessively compressed to exceed the discharge pressure P during the period after the extended line M1 of the back surface 58*d* of the vane 58 provided downstream of the rotation direction W of the compression room 43 passes through the entire discharge hole 46*b* of the sub-discharge section 46 (the state illustrated in FIG. 6A) until the extended line M1 passes through the entire discharge hole 46*b* of the sub-discharge section 46 (the state illustrated in FIG. 6B).

In the compressors 100, 100', 100" of Embodiments 1 to 3 and Modified Examples, five vanes 58 are provided. However, each air compressor according to the present invention is not limited to the above embodiments. The number of vanes can be selectable such as two, three, four, or six. If the selected number of vanes is applied to the air compressor, such a compressor can obtain the functions and effects similar to the compressors 100, 100', 100" of the above embodiments.

In addition, each of the compressors 100, 100', 100" is automatic as described above. However, the air compressor according to the present invention is not limited to the automatic air compressor, and can be a mechanical air compressor. If a mechanical air compressor is used as the compressor 100, 100', 100" of the present embodiment, the rotation axis 51 projects outside from the front cover 12, and a pulley or a gear which receives the transfer of the power from an engine of a vehicle is provided in the projected leading end portion of the rotation shaft 51 instead of providing the motor unit 90.

EXPLANATION OF THE REFERENCE NUMERALS

10: housing
12: front cover
20: front side block
30: rear side block
40: cylinder member
42: cylinder room
43, 43A, 43B, 43C: compression room
45: (main) discharge section
46: sub-discharge section, another sub-discharge section
50: rotor
51: rotation shaft
58: vane
60: compressor unit (compressor main body)
100, 100', 100": compressor (gas compressor)
G: refrigerant gas (gas)
P: discharge pressure
R: refrigeration oil
W: rotation direction

The invention claimed is:

1. A gas compressor, comprising:

a hollow cylinder member;

a rotor rotatably disposed inside the hollow cylinder member;

a plurality of vanes attached to the rotor in a projectable and houseable manner, the plurality of vanes including leading ends which are in contact with an inner circumferential surface of the hollow cylinder member, so as to define a plurality of compression rooms inside the hollow cylinder member, wherein:

a cylinder room which changes a volume of each of the plurality of compression rooms, and performs a gas compression cycle is defined between the hollow cylinder member and the rotor, a suction section which sucks the gas is upstream of the cylinder room, a discharge section which discharges the gas is downstream of the cylinder room, a proximal section in which the hollow cylinder member and the rotor come closest to each other is in one position between the hollow cylinder member and the rotor, so that the cylinder room is defined and is a single cylinder room which performs the gas compression cycle one time per one cycle for each of the plurality of compression rooms, the cylinder room has an asymmetric shape such that a distant section in which the inner circumferential surface of the hollow cylinder member is furthest apart from an outer circumferential surface of the rotor is located upstream of a position to which the proximal section faces across a rotation center of the rotor in a rotation direction, at least one sub-discharge section, which maintains discharge pressure of the gas by releasing pressure of one of the plurality of compression rooms when the pressure of the gas in the one of the plurality of compression rooms reaches the discharge pressure, is upstream of the discharge section, an interval between the at least one sub-discharge section and the discharge section adjacent to the at least one sub-discharge section is the same as or narrower than an interval between leading ends of an adjacent two of the plurality of vanes, and in a state in which a downstream one of the adjacent two of the plurality of vanes faces the discharge section, the at least one sub-discharge section is in a position closer to an upstream one of the adjacent two of the plurality of vanes than the downstream one of the adjacent two of the plurality of vanes.

2. The gas compressor according to claim 1, wherein the at least one sub-discharge section is disposed such that an interval along the inner circumferential surface of the hollow cylinder member between closest end portions of the discharge section and the at least one sub-discharge section next to each other along the rotation direction is shorter than an interval along the inner circumferential surface of the hollow cylinder member between contact points where the leading ends of the adjacent two of the plurality of vanes along the rotation direction are in contact with the inner circumferential surface of the hollow cylinder member.

3. The gas compressor according to claim 1, wherein the at least one sub-discharge section includes a first sub-discharge section and a second sub-discharge section adjacent to the first sub-discharge section, an interval between the first sub-discharge section and the second sub-discharge section is the same as or narrower than the interval between the leading ends of the adjacent two of the plurality of vanes, and in a state in which the downstream one of the adjacent two of the plurality of vanes faces the first sub-discharge section, the second sub-discharge section is in a position closer to the upstream one of the adjacent two of the plurality of vanes than the downstream one of the adjacent two of the plurality of vanes.

4. The gas compressor according to claim 1, wherein the at least one sub-discharge section includes a first sub-discharge section and a second sub-discharge section next to each other along the rotation direction and, an interval along the inner circumferential surface of the hollow cylinder member between closest end portions of the first sub-discharge section and the second sub-discharge section next to each other along the rotation direction is shorter than an interval along the inner circumferential surface of the hollow cylinder member between contact points where the leading ends of the adjacent two of the plurality of vanes along the rotation direction are in contact with the inner circumferential surface of the hollow cylinder member.

5. The gas compressor according to claim 1, wherein the at least one sub-discharge section is disposed such that a total of an opening area of the discharge section and an opening area of the at least one sub-discharge section becomes equal to or larger than an entire opening area of a smaller one of the discharge section and the at least one sub-discharge section when an axis of a downstream facing surface of the upstream one of the adjacent two of the plurality of vanes is overlapped with the at least one sub-discharge section or has contact with an upstream end portion of the at least one sub-discharge section and an axis of an upstream facing surface of the downstream one of the adjacent two of the plurality of vanes is overlapped with the discharge section or has contact with a downstream end portion of the discharge section.

6. The gas compressor according to claim 5, wherein the at least one sub-discharge section is in a position where the entire at least one sub-discharge section and the entire discharge section are simultaneously open after the axis of the upstream facing surface of the downstream one of the adjacent two of the plurality of vanes has passed through the entire discharge section and before the axis of the downstream facing surface of the upstream one of the adjacent two of the plurality of vanes passes over the at least one sub-discharge section.

7. The gas compressor according to claim 1, wherein the at least one sub-discharge section is in a position such that a center of an opening of the at least one sub-discharge section is downstream of an axis of a downstream facing surface of an upstream one of the adjacent two of the plurality of vanes when an axis of an upstream facing surface of a downstream one of the adjacent two of the plurality of vanes passes through a center of an opening of the discharge section.

8. The gas compressor according to claim 1, wherein the distant section is between the proximal section and a position 90 degrees from the proximal portion in the rotation direction.

* * * * *